US009096409B2

(12) United States Patent
Koyanagi

(10) Patent No.: US 9,096,409 B2
(45) Date of Patent: Aug. 4, 2015

(54) SHEET CONVEYING APPARATUS AND IMAGE FORMING APPARATUS

(75) Inventor: Noriaki Koyanagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 13/161,707

(22) Filed: Jun. 16, 2011

(65) Prior Publication Data

US 2012/0001384 A1 Jan. 5, 2012

(30) Foreign Application Priority Data

Jun. 30, 2010 (JP) ..... 2010-150244

(51) Int. Cl.

| | |
|---|---|
| ***B65H 85/00*** | (2006.01) |
| ***B65H 29/52*** | (2006.01) |
| ***B65H 5/38*** | (2006.01) |
| ***B65H 5/06*** | (2006.01) |

(52) U.S. Cl.

CPC ..... *B65H 85/00* (2013.01); *B65H 5/062* (2013.01); *B65H 5/38* (2013.01); *B65H 29/52* (2013.01); *B65H 2402/441* (2013.01); *B65H 2402/61* (2013.01); *B65H 2404/6111* (2013.01); *B65H 2601/26* (2013.01); *B65H 2801/06* (2013.01)

(58) Field of Classification Search

CPC ..... B65H 5/38; B65H 29/52; B65H 85/00; B65H 2402/44; B65H 2402/441

USPC ..... 399/110, 124, 125

See application file for complete search history.

(56) References Cited

U.S. PATENT DOCUMENTS

| | | | | |
|---|---|---|---|---|
| 5,305,995 | A | 4/1994 | Nakajima et al. | |
| 6,134,404 | A * | 10/2000 | Iwai et al. | 399/110 |
| 6,571,074 | B2 * | 5/2003 | Suzuki et al. | 399/124 |
| 6,782,223 | B2 * | 8/2004 | Yoshida | 399/124 |
| 7,168,701 | B2 * | 1/2007 | Isaka et al. | 271/273 |
| 7,317,887 | B2 * | 1/2008 | Otaka | 399/124 |
| 7,577,394 | B2 * | 8/2009 | Sekiya | 399/405 |
| 7,643,772 | B2 * | 1/2010 | Koshida | 399/110 |
| 7,748,691 | B2 | 7/2010 | Mizuguchi | |
| 7,865,110 | B2 * | 1/2011 | Yamazaki | 399/110 |
| 2006/0083543 | A1 * | 4/2006 | Sunohara | 399/110 |
| 2009/0267283 | A1 | 10/2009 | Mizuguchi | |
| 2010/0098473 | A1 * | 4/2010 | Hosoi | 399/400 |
| 2010/0329738 | A1 * | 12/2010 | Shirai | 399/124 |
| 2012/0263493 | A1 * | 10/2012 | Okabe et al. | 399/110 |

FOREIGN PATENT DOCUMENTS

| | | | |
|---|---|---|---|
| JP | 2008-063060 | | 3/2008 |
| JP | 2009-263078 | A | 11/2009 |
| JP | 5031653 | B2 | 9/2012 |

* cited by examiner

*Primary Examiner* — Ernesto Suarez

(74) *Attorney, Agent, or Firm* — Fitzpatrick, Cella, Harper & Scinto

(57) ABSTRACT

A sheet conveying apparatus of the present invention includes an apparatus body, a conveyance unit which is movably supported by the apparatus body toward an outside of the apparatus body, and includes a sheet conveying path, a conveying guide which forms the sheet conveying path, and is rotatably supported on the conveyance unit wherein in a state that the conveyance unit moves to the outside, the conveying guide can be held in an opening position where the sheet conveying path is opened, and an interlock portion which causes a closure of the conveying guide held in the opening position through interlocking with an operation of mounting the conveyance unit in the apparatus body.

25 Claims, 22 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, and more particularly relates to a sheet conveying apparatus provided with a conveying guide in a door portion of an apparatus body, and an image forming apparatus including this sheet conveying apparatus.

2. Description of the Related Art

In the related art, image forming apparatuses such as a copying machine and a laser beam printer transfer a toner image, formed on the surface of a photosensitive drum, to a sheet and conveys the sheet to a fixing apparatus for heating and fixing, to obtain a predetermined image. Therefore, for example when paper jam (hereinafter also referred to as "jam") occurs during conveyance of the sheet, a user needs to open a conveying guide arranged inside an apparatus body and remove the sheet remaining in a conveying path.

Meanwhile, in recent years, with reduction in size of an apparatus body having been desired, the image forming apparatus has been required to effectively make use of an inner space therein. For this reason, there are an increasing number of image forming apparatuses configured such that the conveying guide is provided in a door portion of the apparatus body while jam recovery in the conveying path can be performed by opening the conveying guide provided in the door portion (see Japanese Patent Laid-Open No. 2008-63060).

Incidentally, among the image forming apparatuses which perform jam recovery by opening the conveying guide provided in the door portion, there are those having the function of holding the conveying guide so as to be kept in an open state even when the user releases his or her hand (hereinafter also referred to as "independent holding") in order to improve maintenance properties and the like.

However, when the conveying guide is independently held for the jam recovery, for example, the user may intend to close the door portion without cancellation of the independent holding after completion of the jam recovery, which might cause breakage or damage of the conveying guide. Further, for example in the case of closing the door portion while closing the conveying guide after cancellation of the independent holding of the conveying guide, when the conveying guide comes into contact with the apparatus body before the conveying guide is completely closed, the conveying guide might be subjected to damage or the like.

Thereat, the present invention provides a sheet conveying apparatus capable of suppressing damage of a conveying guide provided in a door portion of an apparatus body, and an image forming apparatus including this sheet conveying apparatus.

SUMMARY OF THE INVENTION

A sheet conveying apparatus according to the present invention includes an apparatus body, a conveyance unit which is movably supported by the apparatus body toward an outside of the apparatus body, and includes a sheet conveying path, a conveying guide which forms the sheet conveying path, and is rotatably supported on the conveyance unit, wherein in a state that the conveyance unit moves to the outside, the conveying guide can be held in an opening position, and an interlock portion which causes a closure of the conveying guide in a state of opening the sheet conveying path through interlocking with an operation of mounting the conveyance unit in the apparatus body.

As in the present invention, the interlock portion interlocks so as to close the conveying guide, thereby allowing suppression of damage of the conveying guide provided in the conveying unit.

Further features of the present invention will become apparent from the following description of exemplary embodiments with reference to the attached drawings.

DESCRIPTION OF THE EMBODIMENTS

Hereinafter, a sheet conveying apparatus and an image forming apparatus according to an embodiment of the present invention is described with reference to the drawings. The image forming apparatus according to the embodiment of the present invention is an image forming apparatus having a sheet conveying portion as a sheet conveying apparatus provided with a conveying guide which forms a sheet conveying path in a door portion of an apparatus body, such as copying machine, a printer, a facsimile machine, and a complex apparatus of these. In the following embodiment, a description is given using a laser beam printer 1 as the image forming apparatus.

Figure 1:
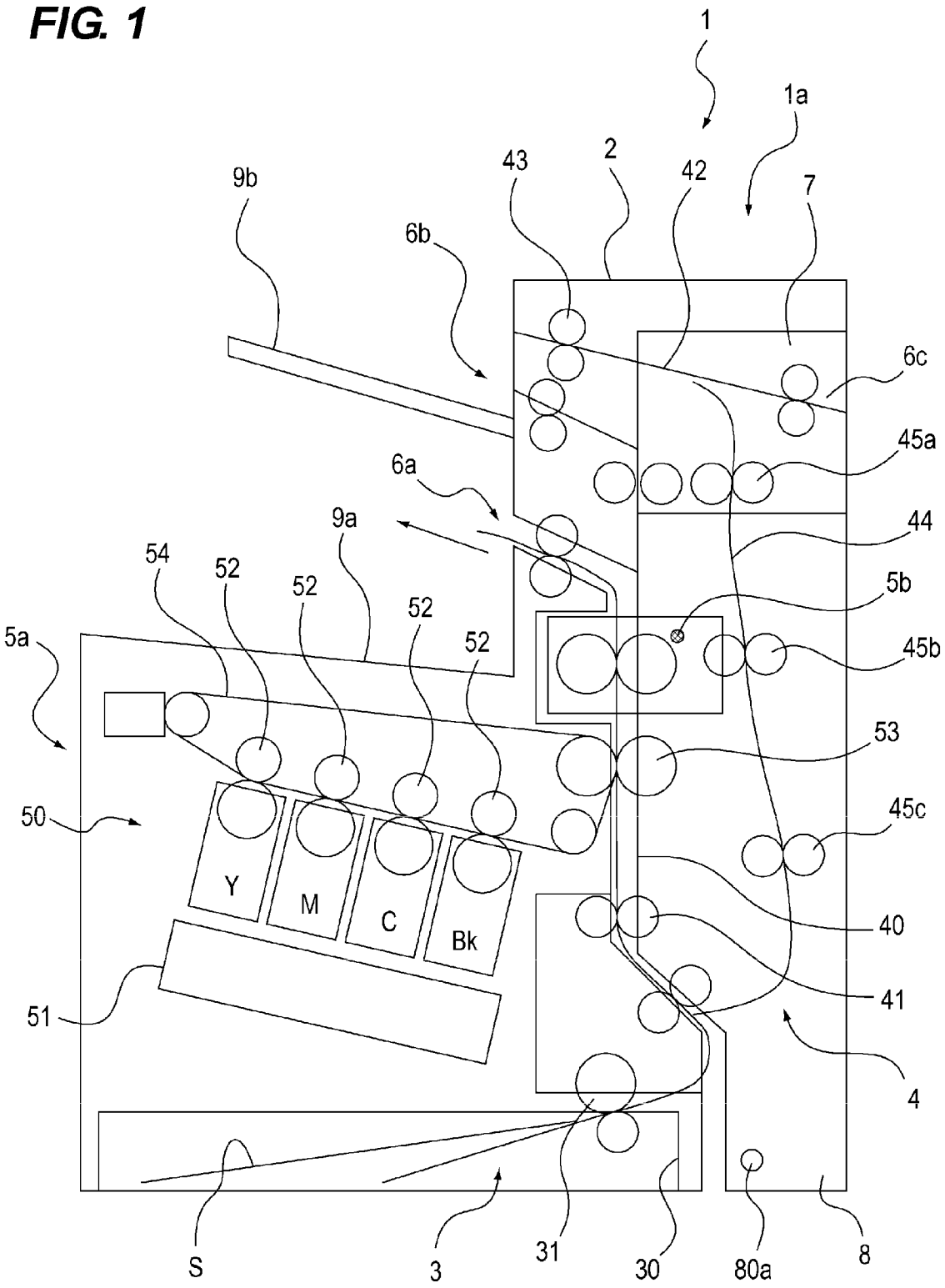
FIG. 1 is a cross-sectional view schematically illustrating an internal structure of a laser beam printer according to an embodiment of the present invention.
Figure 2A:
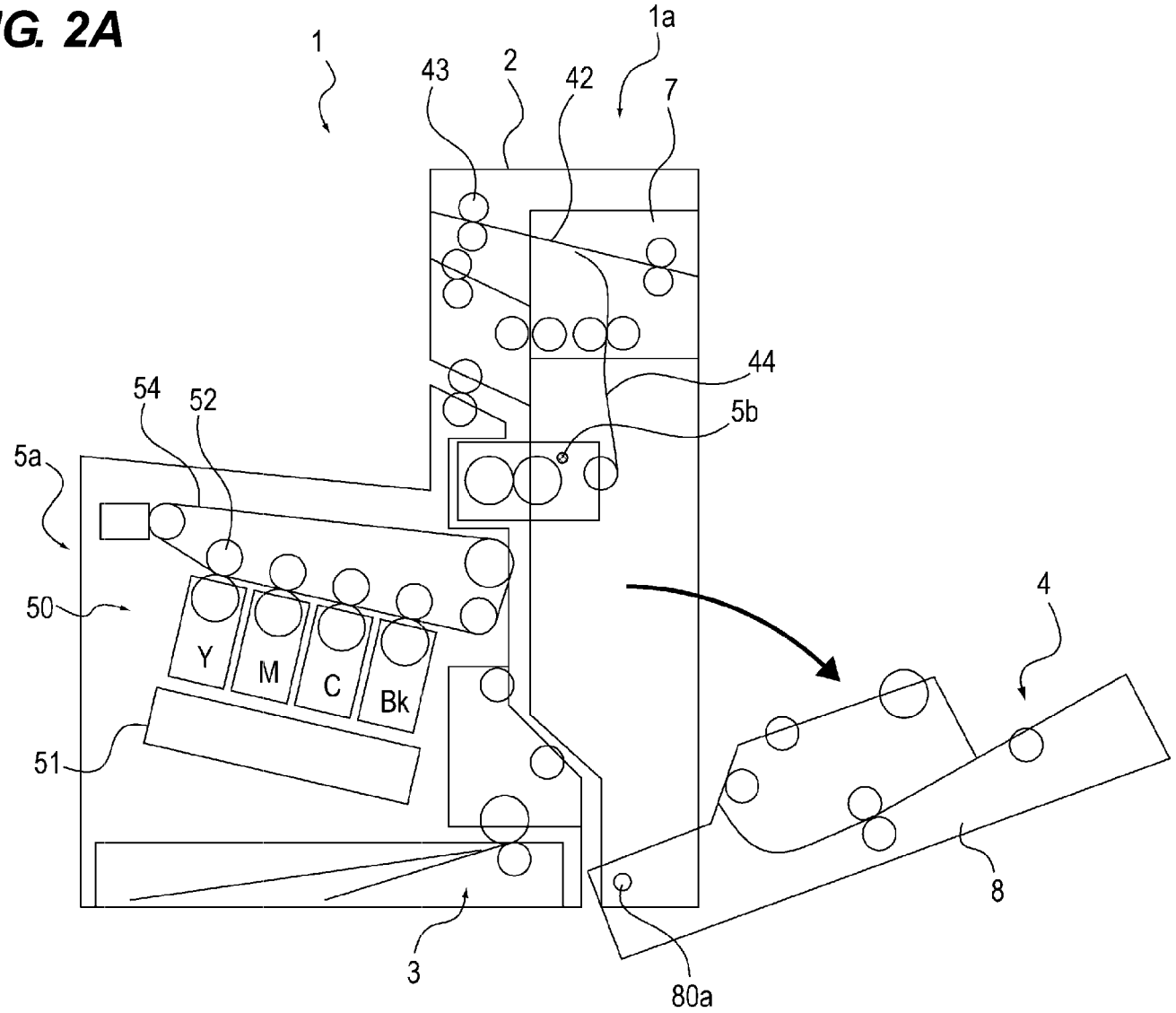
FIG. 2A is a cross-sectional view schematically illustrating an internal structure in a state where a second door portion is opened in the laser beam printer according to the present embodiment.
Figure 2B:
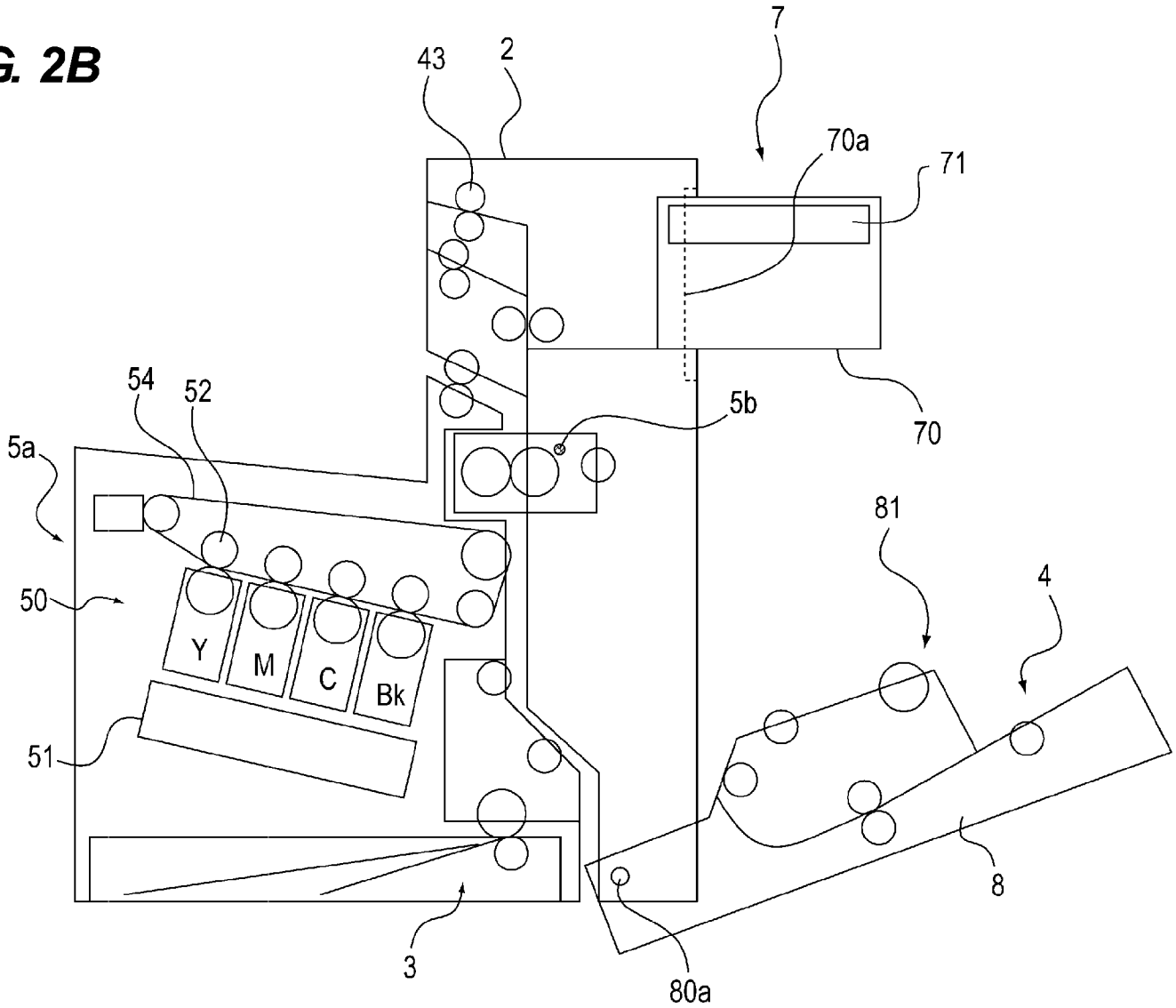
FIG. 2B is a cross-sectional view schematically illustrating an internal structure in a state where a first door portion is opened in the laser beam printer illustrated in FIG. 2A.
Figure 2C:
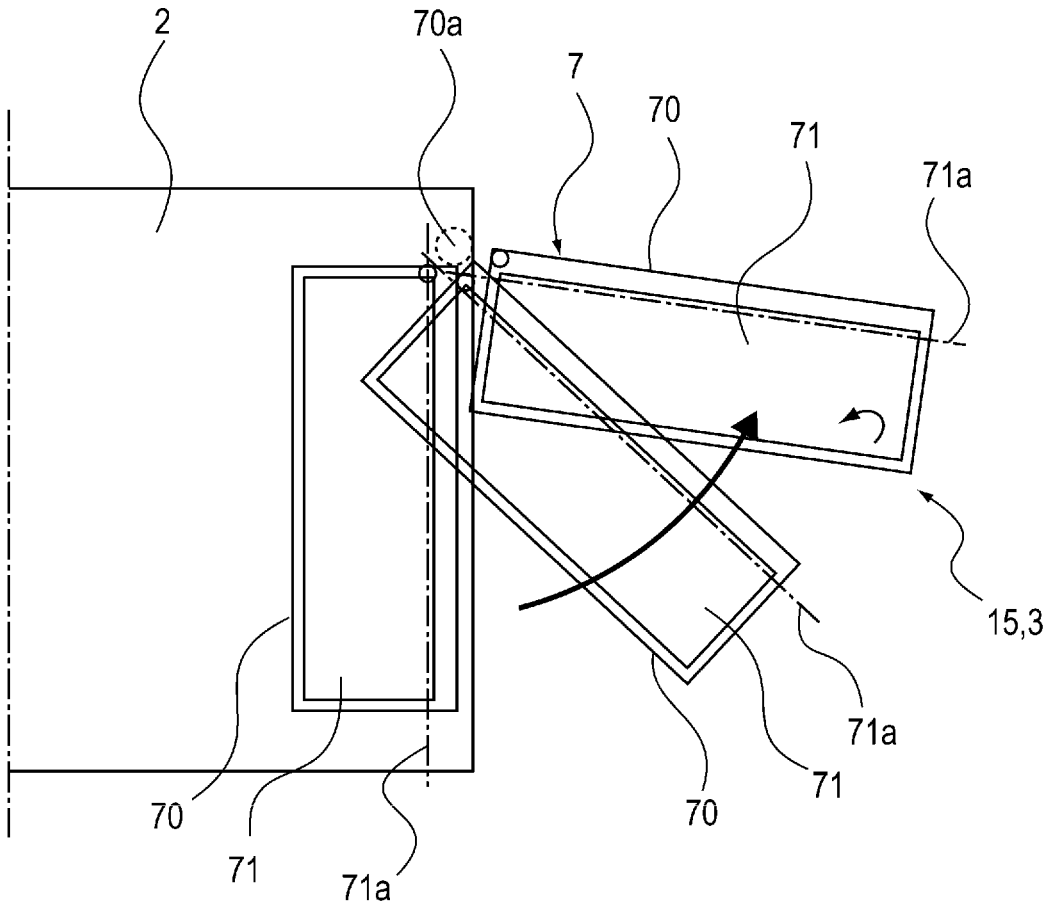
FIG. 2C is a plan view schematically illustrating the state of opening the first door portion illustrated in FIG. 2B.

First, an entire configuration of the laser beam printer 1 according to the embodiment of the present invention is described with reference to FIGS. 1 and 2. FIG. 1 is a cross-sectional view schematically illustrating an internal structure of the laser beam printer 1 according to the embodiment of the present invention. FIG. 2A is a cross-sectional view illustrating a state where a second door portion 8 is opened in the laser beam printer 1 according to the present embodiment. FIG. 2B is a cross-sectional view illustrating a state where a first door portion 7 is opened in the laser beam printer 1 illustrated in FIG. 2A. FIG. 2C is a plan view illustrating the state where the first door portion 7 illustrated in FIG. 2B is opened.

As illustrated in FIGS. 1 and 2, the laser beam printer 1 includes a sheet conveying portion 1*a* and an image forming portion 5*a* which forms an image. The sheet conveying portion 1*a* is provided with a printer body 2 as an apparatus body, a sheet feeding portion 3 which feeds a sheet S, a sheet conveying portion 4 which conveys the sheet S, and a fixing portion 5*b* which fixes an image. The sheet conveying portion 1*a* is provided with a first ejection portion 6*a*, a second ejection portion 6*b* and a third ejection portion 6*c* which eject the sheet S formed with an image, and the first door portion 7 and the second door portion 8 which are openably supported by the printer body 2. Either the first door portion 7 or the second door portion 8 is arranged so as to be opened and move to the outside of the printer body 2. Further, the sheet conveying portion 1*a* is provided with a first ejected paper stacking portion 9*a* and a second ejected paper stacking portion 9*b* which stack the sheets S formed with an image.

The printer body 2 accommodates, in its inside, the sheet feeding portion 3, the sheet conveying portion 4, the image forming portion 5*a*, the fixing portion 5*b*, and the like, while constituting an appearance of the laser beam printer 1. The sheet feeding portion 3 is provided with a sheet cassette 30 which accommodates the sheet S, a pair of feed rollers 31 which feeds the sheet S accommodated in the sheet cassette 30 to the image forming portion 5*a*, and a separation portion (not illustrated) which separates the sheets S one by one. The sheet feeding portion 3 feeds the sheet S accommodated in the sheet cassette 30 to the sheet conveying portion 4 by means of the pair of feed rollers 31 while separating the sheets one by one in the separation portion.

The sheet conveying portion 4 is provided with a longitudinal conveying path 40, a registration roller 41, a reverse path 42, a pair of reverse rollers 43, a duplex conveying path 44, and pairs of duplex conveying paths 45*a*, 45*b*, and 45*c*. The longitudinal conveying path 40 is a conveying path for conveying the sheet S fed from the sheet feeding portion 3 and the sheet S conveyed from the duplex conveying path 44. The registration roller 41 is provided in the longitudinal conveying path 40, and performs skew correction in a case where the sheet has been conveyed in a skew feeding manner, and some other operations. Further, the registration roller 41 conveys the sheet S in association with the timing of image formation in the image forming portion 5*a*.

The reverse path 42 is coupled to the longitudinal conveying path 40, and is a conveying path for making the pair of reverse rollers 43, which performs switch-back reverse conveyance, reverse the sheet S. The duplex conveying path 44 is branched off from the reverse path 42 and coupled to the longitudinal conveying path 40, and is a conveying path for conveying the sheet S having been reversed by the pair of reverse rollers 43. The pairs of duplex conveying paths 45*a*, 45*b*, and 45*c* are provided in the duplex conveying path 44, and convey the sheet S flowing along the duplex conveying path 44.

The image forming portion 5*a* forms an image on the sheet S based on predetermined image information. An image forming portion 6 is provided with a process cartridge portion 50 for forming a primary image with a total of four colors of yellow, magenta, cyan and black, a laser scanner unit 51, a primary transfer roller 52, a secondary transfer roller 53, and a transfer belt 54.

The process cartridge portion 50 is provided with a photosensitive drum (not illustrated), a charging portion (not illustrated), a developing portion (not illustrated), and a cleaning portion (not illustrated). The photosensitive drum is made up of a metal cylinder formed with a photosensitive layer, having a negative charging polarity, on its surface. The charging portion uniformly charges the surface of the photosensitive drum as an image bearing member. The developing portion applies a toner to an electrostatic latent image, to make an image appear as a toner image. The cleaning portion removes the toner remaining on the surface of the photosensitive drum after the transfer.

To form an electrostatic latent image on the photosensitive drum, the laser scanner unit 51 irradiates the photosensitive drum with a laser beam based on image information. The primary transfer roller 52 transfers the toner image on the photosensitive drum to the transfer belt 54. The secondary transfer roller 53 is arranged in the longitudinal conveying path 40, and transfers the toner image on the transfer belt 54 to the sheet S. The fixing portion 5*b* is provided on the downstream side of the secondary transfer roller 53 in the longitudinal conveying path 40, and fixes the transferred image to the sheet S.

The first ejection portion 6*a* is provided in a position branched off from the longitudinal conveying path 40 on the downstream side of the fixing portion 5*b* in the longitudinal conveying path 40. The second ejection portion 6*b* is provided in a position branched off from the longitudinal conveying path 40 on the downstream side of the first ejection portion 6*a* in the longitudinal conveying path 40. The third discharge portion 6*c* is provided in a position branched off from the reverse path 42.

As illustrated in FIGS. 2A to 2C, the first door portion 7 as the conveyance unit is provided on the side surface of the upper side of the printer body 2, and is openably/closably supported by the printer body 2 such that the inside of the printer body 2 is openable. Further, the first door portion 7 is provided with a later-mentioned reverse path guide 71 which forms the reverse path 42.

As illustrated in FIG. 2A, the second door portion 8 is provided on the side surface of the lower side of the printer body 2 (the side below the first door portion 7), and is openably/closably supported by the printer body 2 such that the inside of the printer body 2 is openable. Further, the second door portion 8 is provided with a later-mentioned duplex conveying path guide 81 which forms the duplex conveying path 44.

Next, the first door portion 7 and the second door portion 8 are further specifically described with reference to FIGS. 3A to 11 on top of FIGS. 2A to 2C. First, a configuration of the first door portion 7 is described with reference to FIGS. 3A to 6.

Figure 3A:
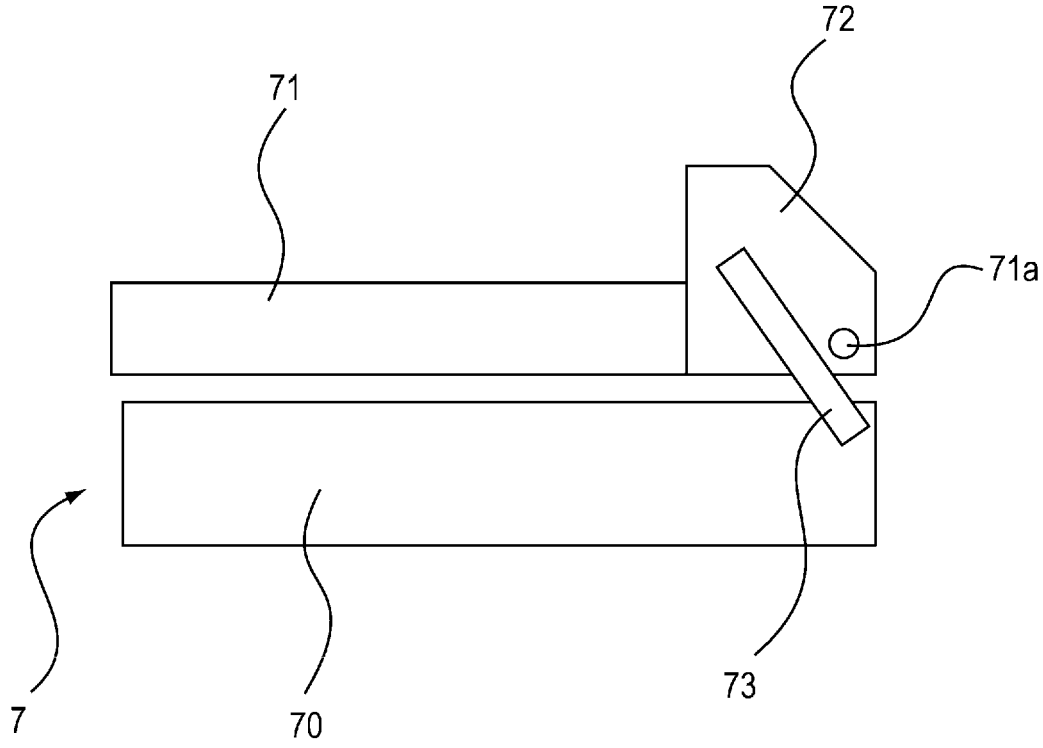
FIG. 3A is a front view illustrating a state where a reverse path guide openably provided in the first door is closed.
Figure 3B:
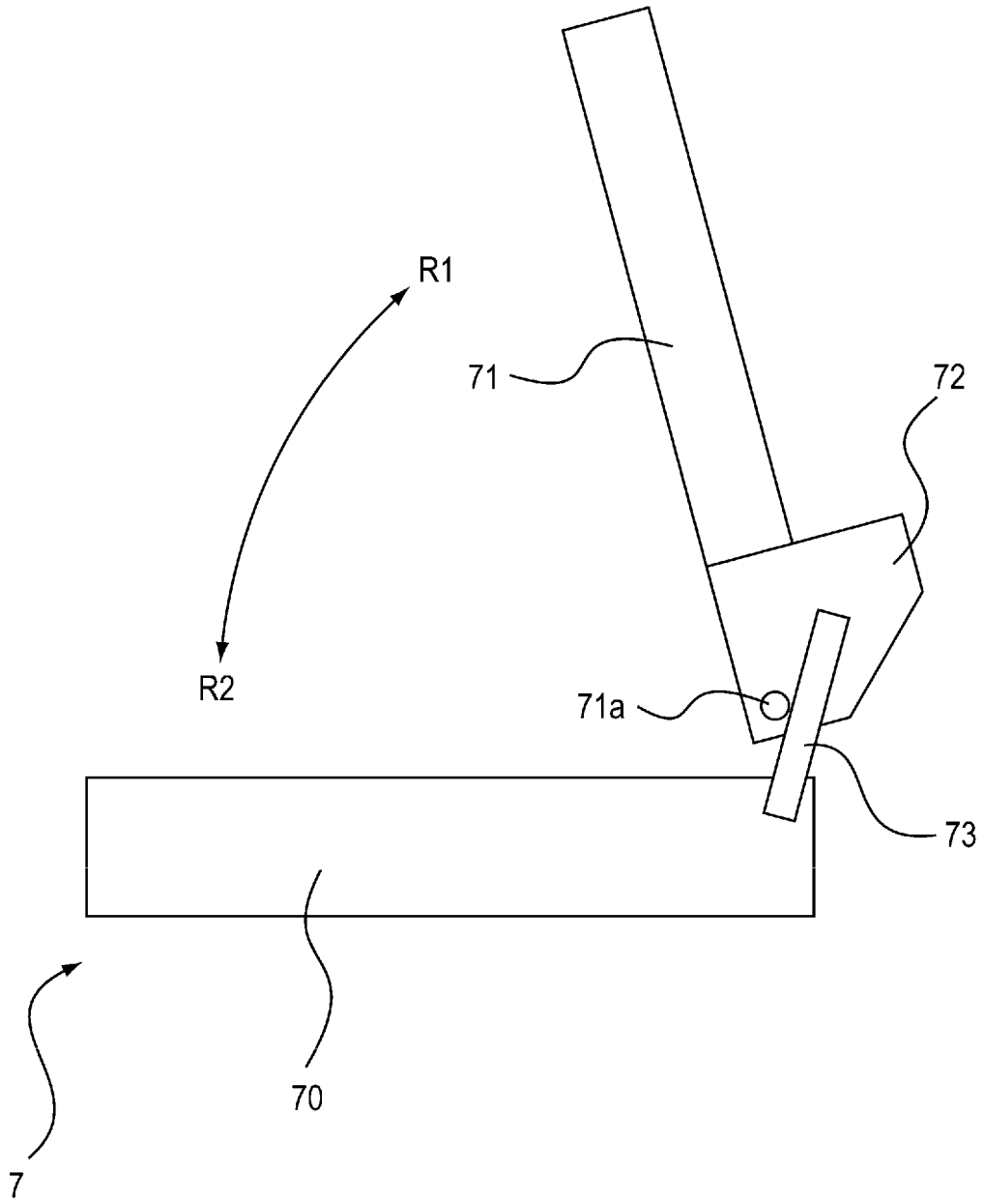
FIG. 3B is a front view illustrating a state where the reverse path guide is opened.
Figure 4:
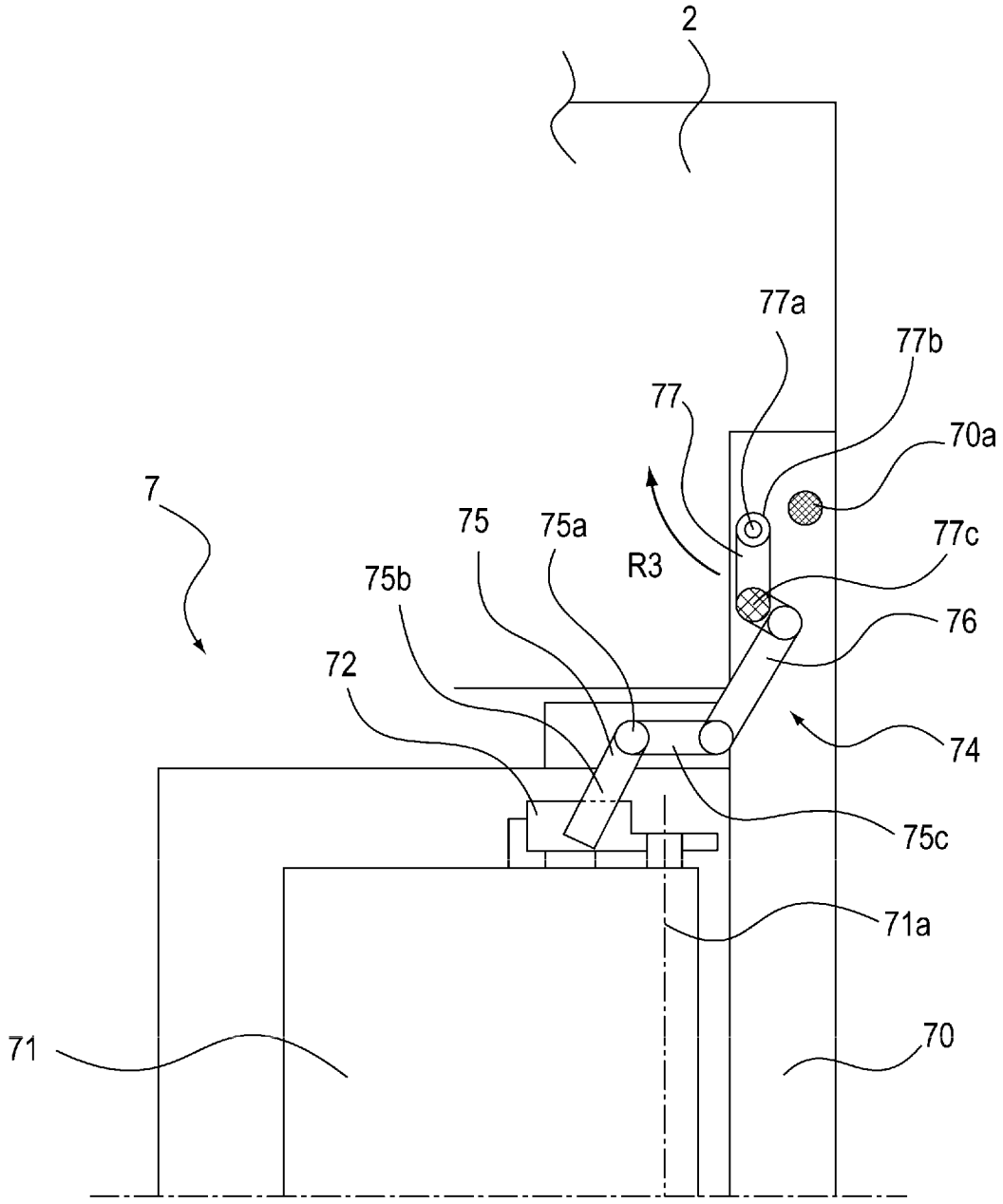
FIG. 4 is a plan view schematically illustrating the first door, the reverse path guide and a link portion in a state where the first door portion is closed.
Figure 5A:
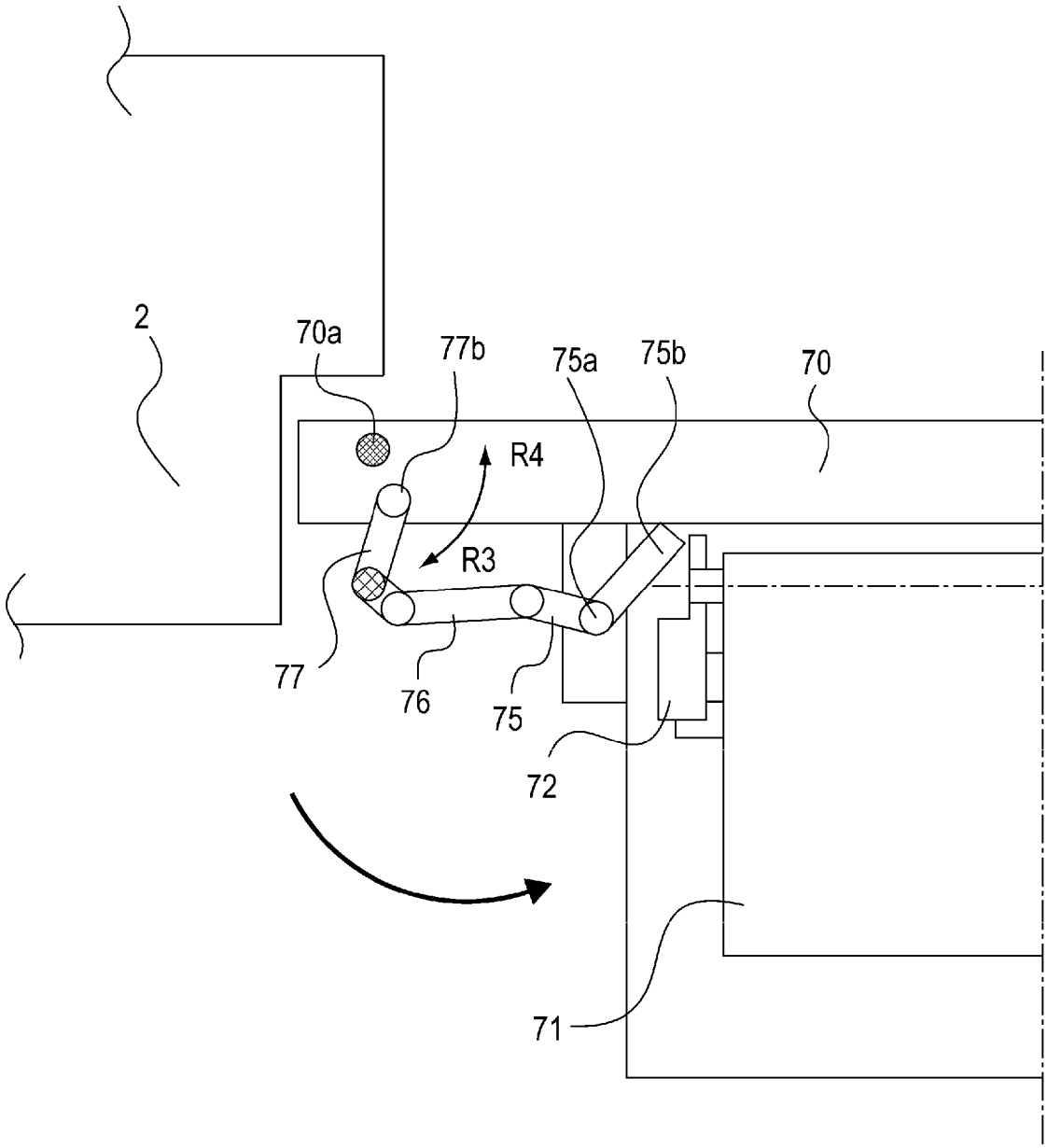
FIG. 5A is a plan view schematically illustrating the first door, the reverse path guide and the link portion in the state where the first door portion is opened.
Figure 5B:
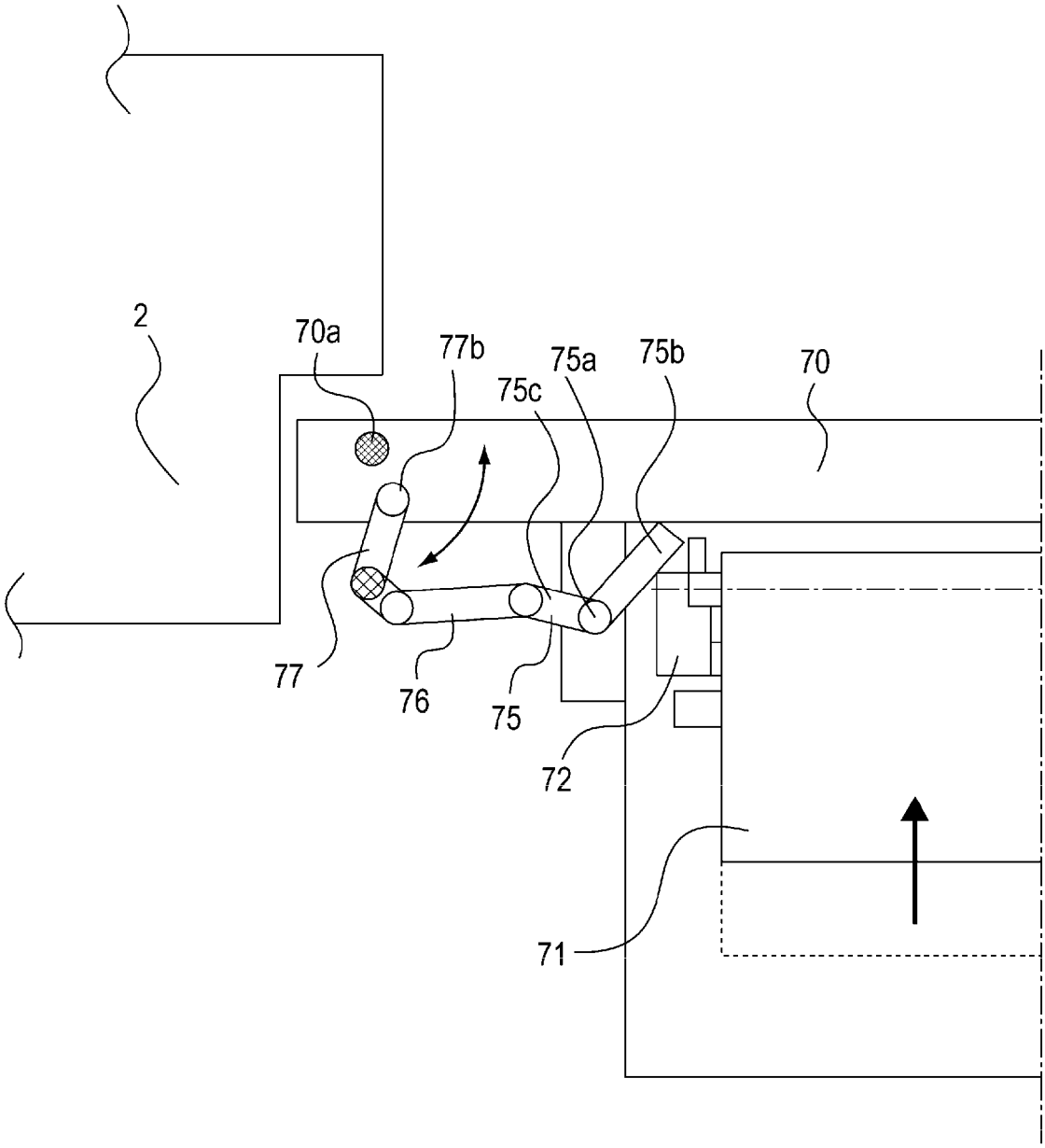
FIG. 5B is a plan view illustrating the state of opening the reverse path guide in the state where the first door is opened as illustrated in FIG. 5A.
Figure 6:
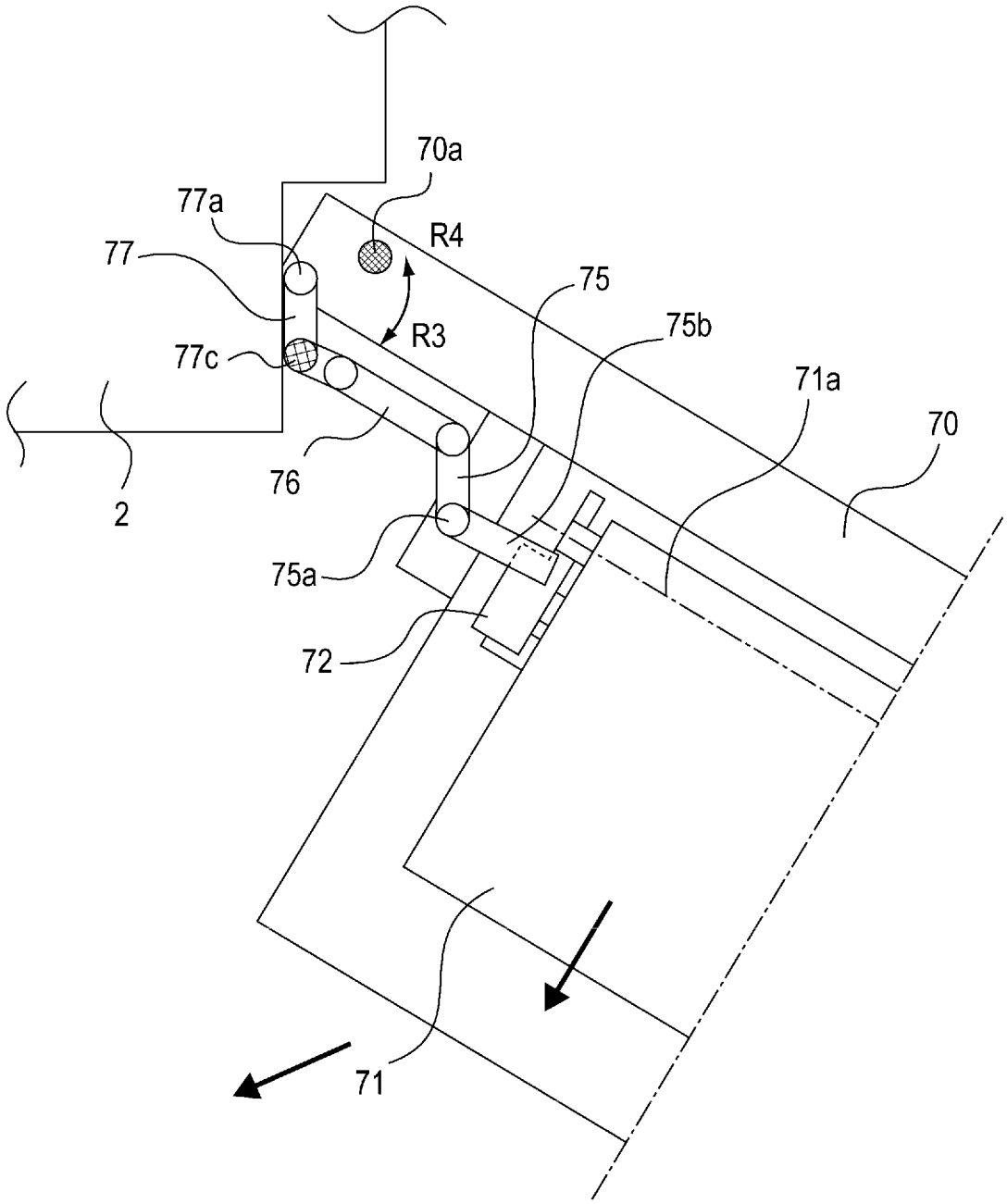
FIG. 6 is a plan view schematically illustrating the first door, the reverse path guide and the link portion in the state where the first door portion is closed as illustrated in FIG. 5.

FIG. 3A is a front view illustrating a state where the reverse path guide 71, which is movably mounted in a first door 70 so as to be openable, is closed. FIG. 3B is a front view illustrating a state where the reverse path guide 71 is opened. FIG. 4 is a plan view schematically illustrating the first door 70, the reverse path guide 71 and a link portion 74 in a state where the first door 70 is closed. FIG. 5A is a plan view schematically illustrating the first door 70, the reverse path guide 71 and the link portion 74 in the state where the first door 70 is opened. FIG. 5B is a plan view illustrating the state of opening the reverse path guide 71 in the state where the first door 70 is opened as illustrated in FIG. 5A. FIG. 6 is a plan view schematically illustrating the first door 70, the reverse path guide 71 and the link portion 74 in the state where the first door 70 is closed as illustrated in FIG. 5B.

As illustrated in FIGS. 3A to 4, the first door portion 7 is provided with the first door 70 which opens and closes the printer body 2, the reverse path guide 71 as the conveying guide which forms the reverse path 42 and the portion 72 to be engaged which is coupled to the reverse path guide 71. Further, the first door portion 7 is provided with a toggle spring 73 as a force applying portion which applies a force to the reverse path guide 71 toward the open position or the closed position, and the link portion 74 as an interlock portion which interlocks with the opening/closing operations of the first door 70. The link portion 74 is actuated with the operation of closing the first door portion 7 (operation of mounting the first door portion 7 in the printer body 1), as later described. The toggle spring 73 and the portion to be engaged constitute a holding portion which holds the reverse path guide 71 so as to be kept in such an open position where the reverse path 42 is opened even when the user releases his or her hand (hereinafter also referred to as "independent holding").

As illustrated in FIGS. 2B and 2C, the first door 70 is openably/closably supported by the printer body 2 with a rotation shaft 70*a*, which extends in a vertical direction of the printer body 2, at the center. That is, the first door 70 is rotated (opens and closes the printer body 2) about the rotation shaft 70*a* in a horizontal direction. As illustrated in FIGS. 2B, 3A and 3B, the reverse path guide 71 is arranged above the first door 70, and rotatably supported by the first door 70 with a rotation shaft 71*a*, which extends in the horizontal direction, at the center. That is, the reverse path guide 71 is configured so as to be rotated around the rotation shaft 71*a* in a first direction (referring to a direction R1 illustrated in FIG. 3, which is hereinafter also referred to as "first direction R1"), and opened to the side above the first door 70. By opening the reverse path guide 71 upward, the reverse path 42 is opened.

The portion 72 to be engaged is coupled to the reverse path guide 71. Further, the portion 72 to be engaged is provided with a locking portion (not illustrated) which is locked to the first door 70. The locking portion is locked with the first door 70 at a predetermined position to stop the rotation of the reverse path guide 71. The toggle spring 73 has one end coupled with the portion 72 to be engaged, and the other end coupled with the first door 70. The toggle spring 73 applies a force to the reverse path guide 71 in the first direction R1, in a case where the reverse path guide 71 is open wider than a predetermined angle (switching angle) with respect to the first door 70 (for example, in a case where the reverse path guide 71 is located in the position of being stopped by the foregoing locking portion). On the other hand, in a case where the reverse path guide 71 is located at an angle smaller than the predetermined angle (switching angle) with respect to the first door 70, the toggle spring 73 is coupled to the portion 72 to be engaged and the first door 70 so as to apply a force to the reverse path guide 71 in a second direction R2 (see FIG. 3B) which is opposite to the first direction R1.

For example, as illustrated in FIG. 3A, in a state where the reverse path guide 71 is closed with respect to the first door 70 (closed state), the toggle spring 73 as a pulling spring applies a force in the second direction R2 as a direction of closing the reverse path guide 71. On the other hand, when the reverse path guide 71 is opened by an operation of the user and the opening angle of the reverse path guide 71 exceeds the predetermined angle (switching angle), the applied force is switched so as to act in the first direction R1 as a direction of opening the reverse path guide 71. It should be noted that the predetermined angle (switching angle) is, for example, an angle being an opening angle of the toggle spring 73 with respect to the first door 70 (angle formed by the toggle spring 73 and the first door 70) which exceeds 90 degrees.

After the applied force of the toggle spring has been switched so as to apply a force in the first direction R1, the locking portion provided in the portion 72 to be engaged is locked to the first door 70, and by the applied force of the toggle spring 73, the reverse path guide 71 is held in the state of being applied with a force in the first direction R1. That is, the reverse path guide 71 is held by the portion 72 to be engaged and the toggle spring 73.

As illustrated in FIG. 4, the link portion 74 is provided with a first link portion 75, a second link portion 76, and a third link portion 77. The first link portion 75 is formed in substantially L shape, and provided with an intermediate portion 75*a*, a first arm portion 75*b* as an engagement portion extending from the intermediate portion 75*a*, and a second arm portion 75*c* extending from the intermediate portion 75*a*. The first link portion 75 is rotatably supported by the first door 70 with the intermediate portion 75*a* at the center. The first arm portion 75*b* is arranged above the portion 72 to be engaged, with the reverse path guide 71 being in the closed state (see FIG. 4). Further, as illustrated in FIG. 5A, the first arm portion 75*b* is retractably formed in a position so as not to control the position of the portion 72 to be engaged in a case where the first door 70 is opened and the first link portion 75 is rotated about the intermediate portion 75*a*. Further, as illustrated in FIG. 5B, the first arm portion 75*b* is formed engageably with the portion 72 to be engaged in a predetermined position at the time of opening of the reverse path guide 71.

One end of the third link portion 77 is rotatably fitted to the first door 70 with a rotation shaft 77*a* at the center. The one end of the third link portion 77 is fitted with a coil spring 77*b*, and the coil spring 77*b* applies a force to the third link portion 77 clockwise in a plan view (referring to a direction R3 illustrated in FIG. 4, which is hereinafter also referred to as "third direction R3"). Moreover, the third link portion 77 is provided with an abutment portion 77*c*, which abuts the first door 70, on the other end side. One end of the second link portion 76 is rotatably coupled with the end of the second arm portion 75*c* of the first link portion 75, and the other end of the second link portion 76 is rotatably coupled with the other end of the third link portion 77. That is, the second link portion 76 rotatably couples the first link portion 75 with the third link portion 77.

Moreover, the link portion 74 is configured such that a portion in the first link portion 75 which is in contact with the portion 72 to be engaged of the reverse path guide 71 moves in a larger amount than a moving amount of abutment portion 77*c* of the third link portion 77 with the movement of closing the first door 70.

Next described is an operation of the link portion 74 at the time when the first door 70 is opened. As illustrated in FIG. 4, in the state where the first door 70 is closed, the abutment portion 77*c* of the third link portion 77 comes into the state of abutting the printer body 2 to control the applied force of the coil spring 77*b* of the third link portion 77. Therefore, the third link portion 77 is kept in the state of abutting the printer body 2. On the other hand, as illustrated in FIG. 5A, when the first door 70 is opened, the third link portion 77 is moved to the third direction R3 side with the rotation shaft 77*a* at the center by the applied force of the coil spring 77*b*. When the third link portion 77 moves in the third direction R3, the second link portion 76 coupled to the third link portion 77 also moves in the third direction R3. When the second link portion 76 moves in the third direction R3, the second arm portion 75*c* of the first link portion 75, which is coupled with the second link portion 76, is pulled in the third direction R3. When the second arm portion 75*c* is pulled in the third direction R3, the first link portion 75 is rotated about the intermediate portion 75*a*, and the first arm portion 75*b* moves in a fourth direction R4, which is opposite to the third direction. Thereby, the first arm portion 75*b* is retracted to a position so as not to control the position of the portion 72 to be engaged.

As illustrated in FIG. 6, as the first door is being closed, the abutment portion 77*c* of the third link portion 77 abuts the printer body 2, and the third link portion 77 is thereby rotated about the rotation shaft 77*a* in the fourth direction R4. When the third link portion 77 is rotated in the fourth direction R4, the first link portion 75 is rotated about the intermediate portion 75*a* in the third direction R3, via the second link portion 76. When the first link portion 75 is rotated about the intermediate portion 75*a* in the third direction R3, the first arm portion 75*b* moves in the third direction R3. That is, the first arm portion 75*b* of the first link portion 75 moves through interlocking with the opening/closing operations of the first door 70. Specifically, the first arm portion 75*b* moves to a position in accordance with an opening angle of the first door 70.

Figure 7A:
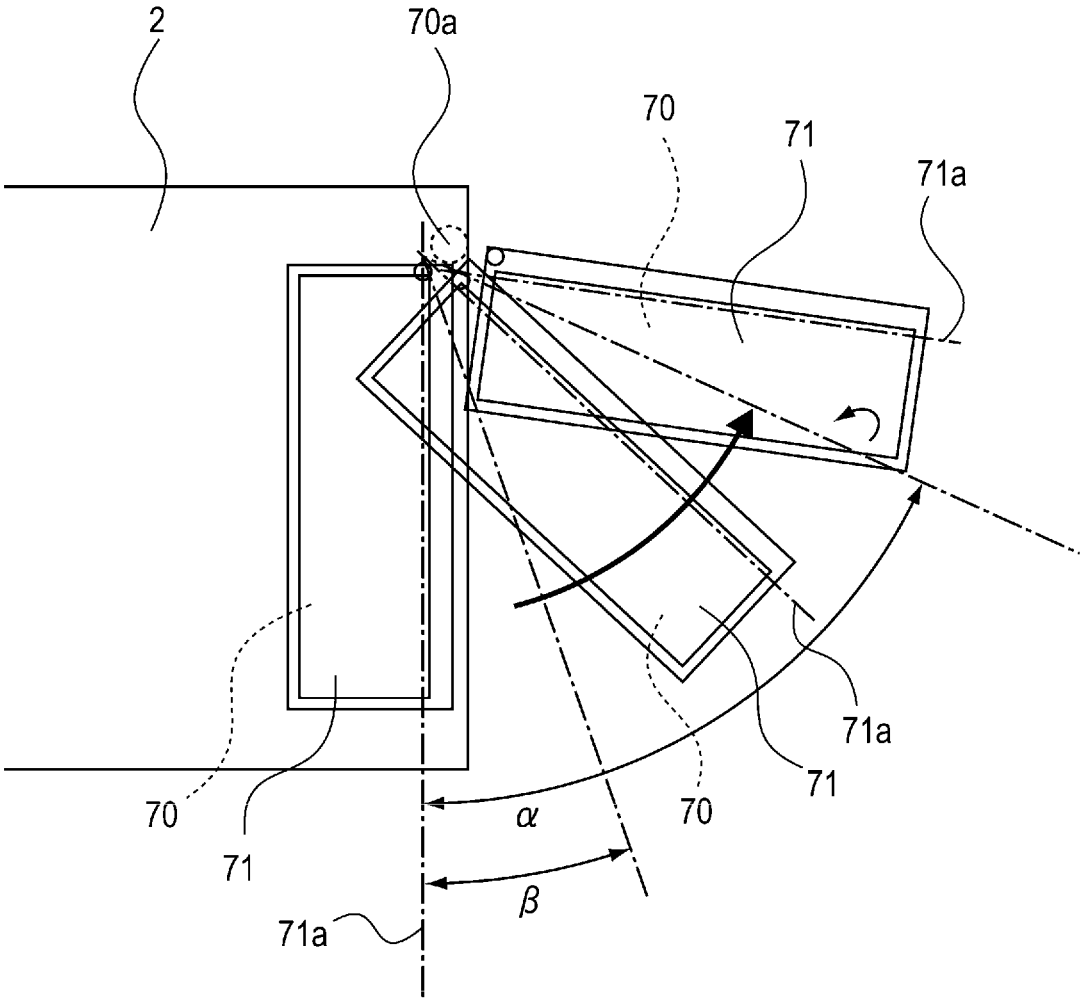
FIG. 7A is a plan view illustrating the state of opening and closing the first door portion.
Figure 7B:
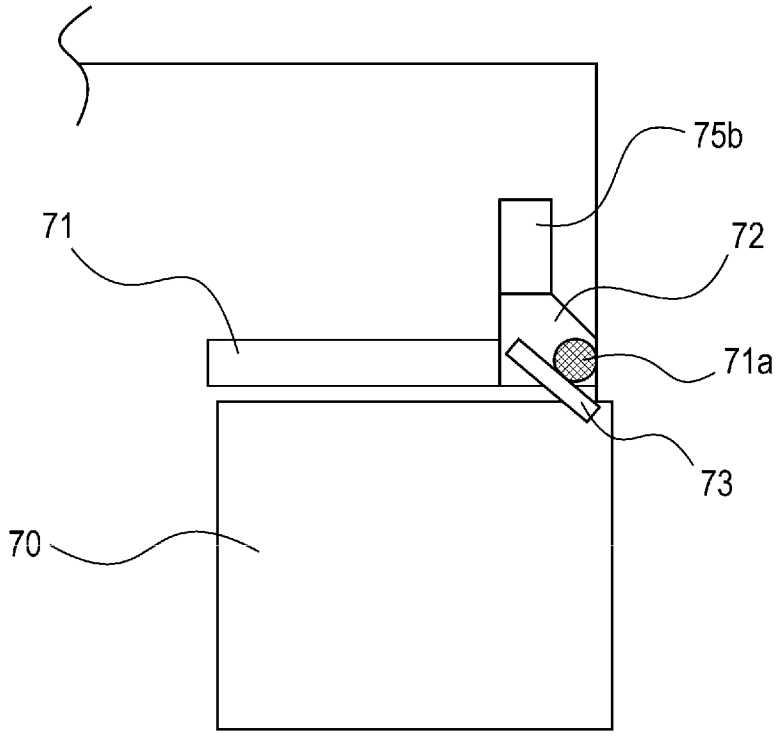
FIG. 7B is a front view schematically illustrating the first door, the reverse path guide and a first arm portion in the state where the first door portion is closed.
Figure 7C:
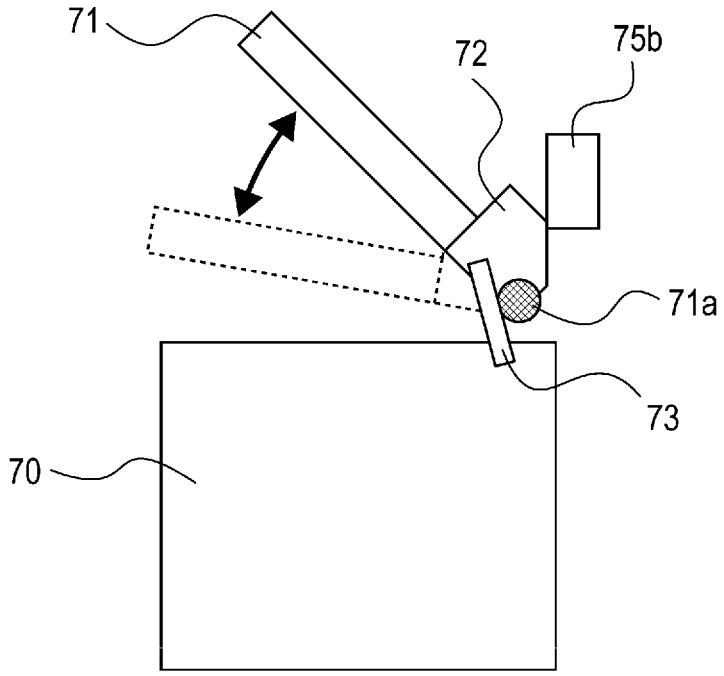
FIG. 7C is a front view schematically illustrating the first door, the reverse path guide and the first arm portion in a state where the reverse path guide is opened.
Figure 7D:
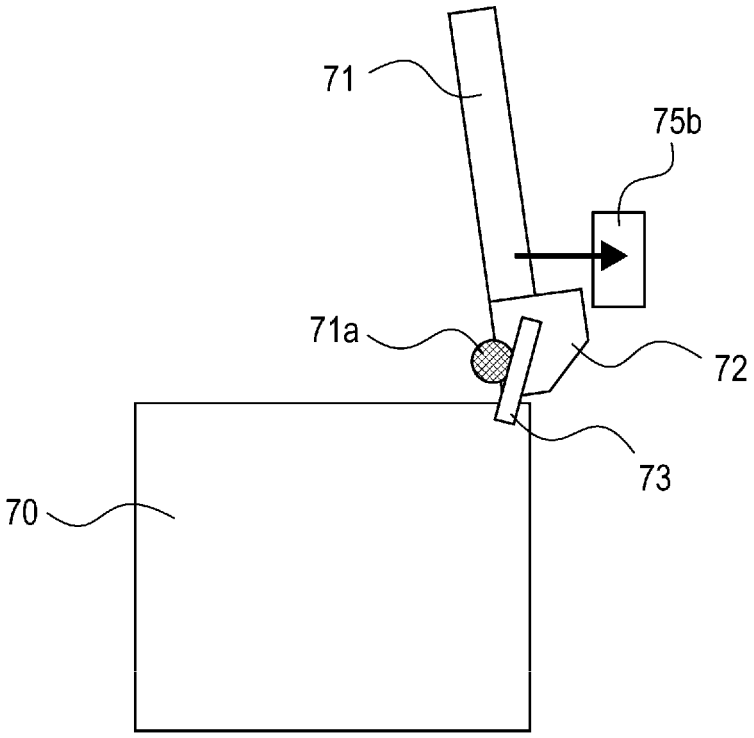
FIG. 7D is a front view schematically illustrating the first door, the reverse path guide and the first arm portion in a state where a reverse conveying path guide is opened.

Next, the independent holding of the reverse path guide in the first door portion 7 is described with reference to FIGS. 7A to 7D on top of FIGS. 4 to 6. FIG. 7A is a plan view illustrating the state of opening and closing the first door 70. FIG. 7B is a front view schematically illustrating the first door 70, the reverse path guide 71 and the first arm portion 75*b* in the state where the first door 70 is closed. FIG. 7C is a front view schematically illustrating the first door 70, the reverse path guide 71 and the first arm portion 75*b* in a state where the reverse path guide 71 is opened while the first door 70 is opened. FIG. 7D is a front view schematically illustrating the first door 70, the reverse path guide 71 and the first arm portion 75*b* in a state where the reverse path guide 71 is opened while the first door 70 is opened.

As illustrated in FIG. 7A, for rotating the reverse path guide 71 to be independently held, first, the first door 70 is opened wider than a first opening angle α. In a state where the first door 70 is opened wider than the first opening angle α, as illustrated in FIGS. 7B to 7D, at the time of opening the reverse path guide 71, the first arm portion 75*b* of the first link portion 75 retracts to a position where it does not control the position of the portion 72 to be engaged which is coupled with the reverse path guide 71. Therefore, as illustrated in FIGS. 7C and 7D, the reverse path guide 71 is movable to a position where it is held by the portion 72 to be engaged and the toggle spring 73.

After the first door 70 has been opened wider than the first opening angle α, the reverse path guide is rotated upward, and rotated to a predetermined open position by the portion 72 to be engaged. When the reverse path guide 71 is rotated to the predetermined open position, the portion to be engaged which is coupled to the reverse path guide 71 is locked with the first door 70, and the reverse path guide 71 is held in the state of being applied with a force by the toggle spring 73 in the first direction R1.

Next described is an operation of closing the first door 70 which is open wider than the first opening angle α, while holding the reverse path guide 71 in the open position. As illustrated in FIG. 6, as the first door 70 is being closed, the abutment portion 77*c* of the third link portion 77 comes into contact with the printer body 2. Thereby, the second link portion 76 and the third link portion 77 move in the fourth direction R4, while the first arm portion 75*b* of the first link portion 75 moves in the third direction.

Then, as illustrated in FIGS. 7A to 7D, when the opening angle of the first door 70 is the first opening angle α, the portion 72 to be engaged is pressed by the first arm portion 75*b* of the first link portion 75. When the portion 72 to be engaged is pressed by the first arm portion 75*b*, it is rotated in a direction where the reverse path guide 71 coupled with the portion 72 to be engaged is closed. Specifically, the reverse path guide 71 is rotated to a position where the applied force of the toggle spring 73 acts in the second direction R2. That is, the independent holding of the reverse path guide 71 by the toggle spring 73 is cancelled by the first arm portion 75*b* of the first link portion 75 in the link portion 74 located in the vicinity of the rotation shaft 71*a*. When the independent holding of the reverse path guide 71 is cancelled, the reverse path guide 71 is closed under its weight and by the applied force of the toggle spring 73 in the second direction R2.

Figure 8A:
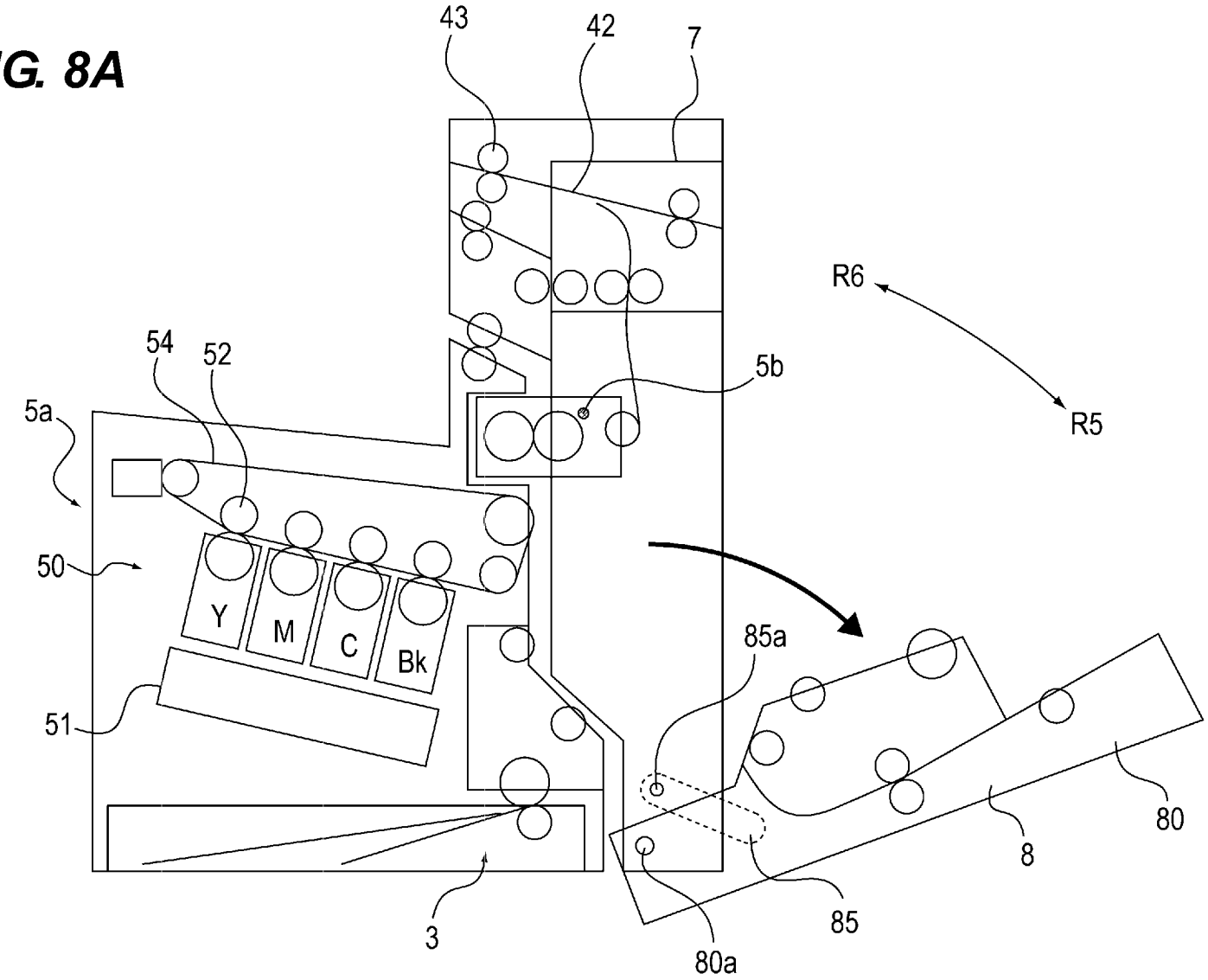
FIG. 8A is a view schematically illustrating a state where the second door portion is opened in the laser beam printer according to the present embodiment.
Figure 8B:
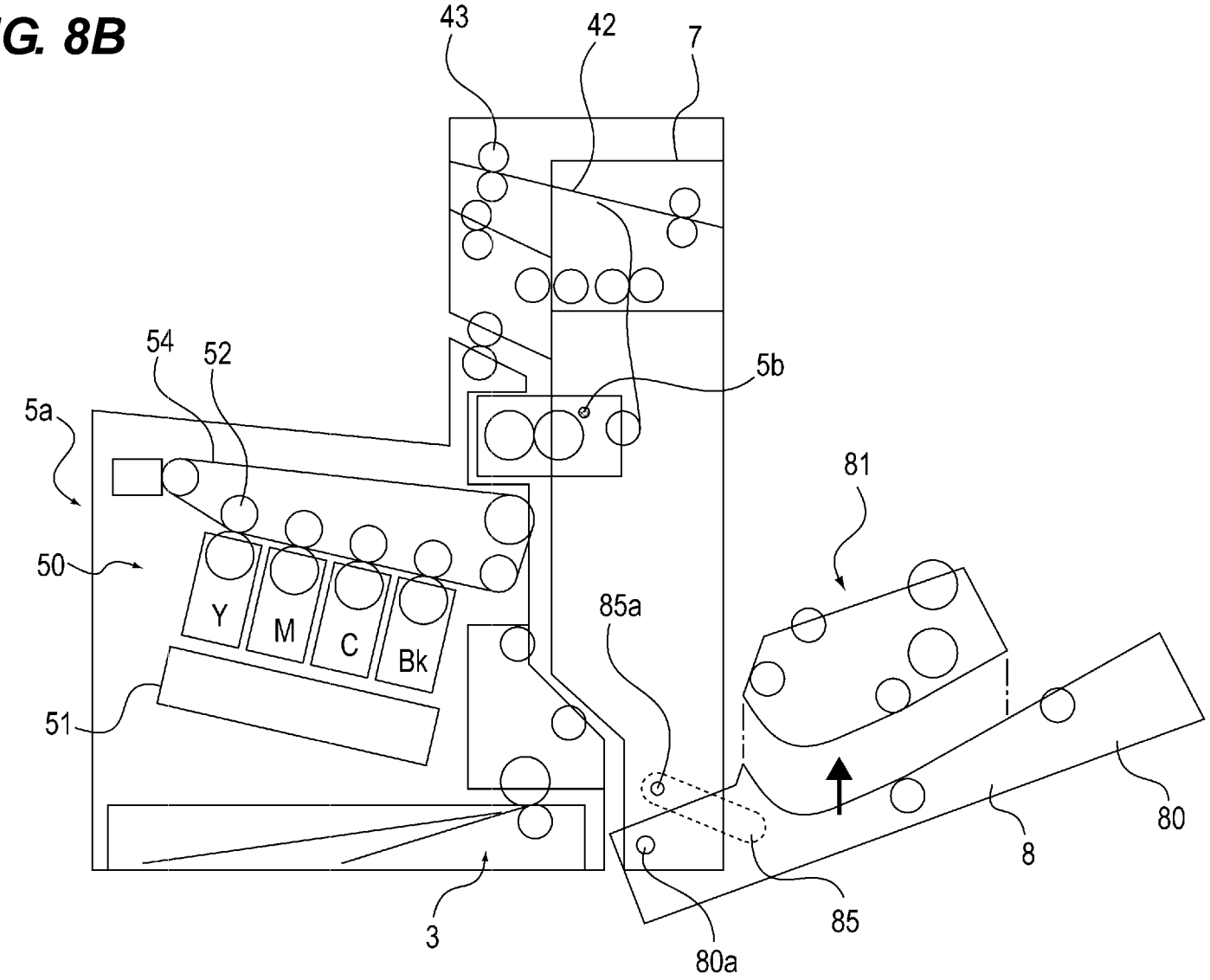
FIG. 8B is a view schematically illustrating a state where a duplex conveying path guide, which is openably mounted in the second door portion illustrated in FIG. 8A, is opened.
Figure 9A:
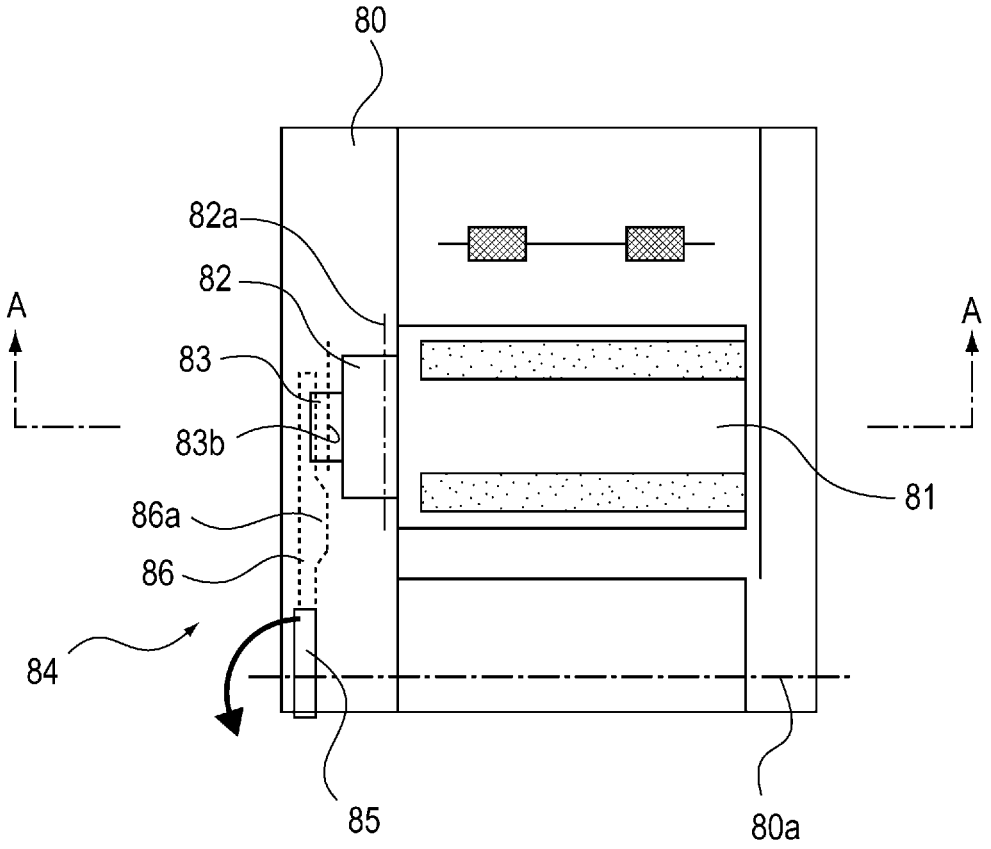
FIG. 9A is a view schematically illustrating an internal structure of the second door portion.
Figure 9B:
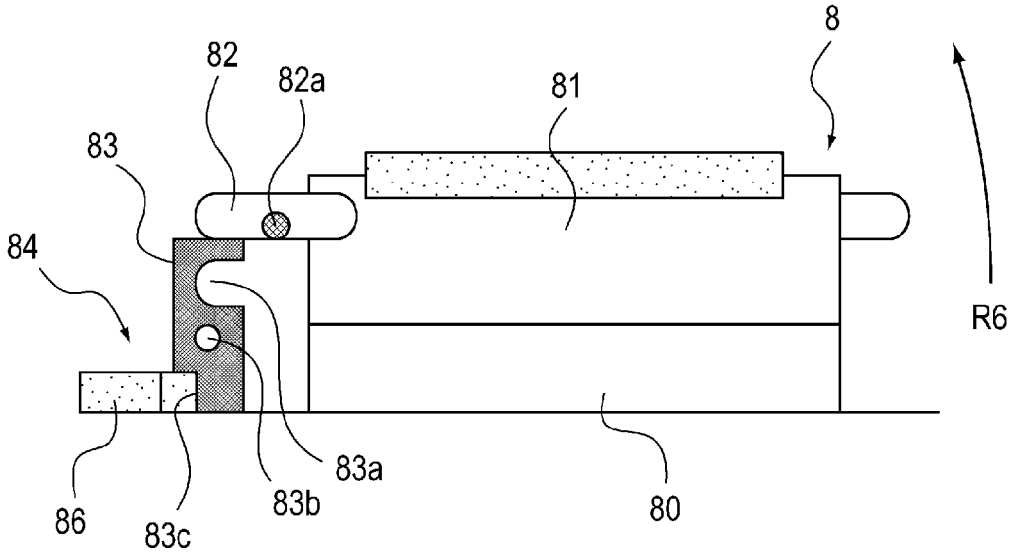
FIG. 9B is a view schematically illustrating a cross section A-A illustrated in FIG. 9A.

Next, the second door portion 8 is described with reference to FIGS. 8A to 11B. First, a configuration of the second door portion 8 is described with reference to FIGS. 8A to 9B. FIG. 8A is a front view schematically illustrating a state where the second door portion 8 is opened in the laser beam printer 1 according to the present embodiment. FIG. 8B is a front view schematically illustrating a state where a duplex conveying path guide, which is openably mounted in the second door portion 8 illustrated in FIG. 8A, is opened. FIG. 9A is a view schematically illustrating an internal structure of the second door portion 8, and FIG. 9B is a view schematically illustrating a cross section A-A illustrated in FIG. 9A.

As illustrated in FIGS. 8A to 9B, the second door portion 8 is provided with a second door 80 as a door portion which opens and closes the printer body 2, a duplex conveying path guide 81 as a conveying guide which forms the duplex conveying path 44, and a first portion 82 to be engaged which is coupled to the duplex conveying path guide 81. Further, the second door portion 8 is provided with a second portion 83 to be engaged to be engaged which is coupled to the second door 80, and a link portion 84 which interlocks with the opening/closing operations of the second door 80. The first portion 82 to be engaged and the second portion 83 to be engaged constitute a holding portion which holds the opening state of the duplex conveying path guide 81 so as to be kept in a predetermined position even when the user releases his or her hand.

As illustrated in FIGS. 8A to 9A, the second door 80 is openably/closably supported by the printer body 2 with a rotation shaft 80*a*, which extends in the horizontal direction (from the front side to the back side of the printer body 2), at the center. That is, the second door 80 is rotated about the rotation shaft 80*a* in a fifth direction (referring to a direction R5 illustrated in FIG. 8A, which is hereinafter also referred to as "fifth direction R5"), to open and close the printer body 2.

The duplex conveying path guide 81 is arranged on the inner surface side of the second door 80, and is rotatably supported by the second door 80 with a rotation shaft 82*a*, which extends in a direction orthogonal to the rotation shaft 80*a* of the second door 80, at the center. That is, the duplex conveying path guide 81 is configured so as to be rotated about the rotation shaft 82*a* in a sixth direction (referring to a direction R6 illustrated in FIG. 9B, which is hereinafter also referred to as "sixth direction R6"), and opened to the side above the second door 80. By opening the duplex conveying path guide 81 upward, the duplex conveying path 44 is opened. The rotation shaft 82*a* is provided in the first portion 82 to be engaged which is coupled to the duplex conveying path guide 81.

The second portion 83 to be engaged is provided with a recessed portion 83*a* which holds the first portion 82 to be engaged, having been rotated about the rotation shaft 82*a* in the sixth direction R6, a rotation shaft 83*b* which extends in parallel with the rotation shaft 82*a*, and a portion 83*c* to be pressed which is pressed by the link portion 84. The recessed portion 83*a* is provided on the side surface of one side above the rotation shaft 83*b*. The portion 83*c* to be pressed is provided on the side surface of the other side below the rotation shaft 83*b*. Further, the second portion 83 to be engaged is applied with a force by a non-illustrated spring in a clockwise direction. The second portion 83 to be engaged holds the first portion to be engaged in the recessed portion 83*a* to hold the duplex conveying path guide 81 coupled to the first portion 82 to be engaged. On the other hand, the second portion 83 to be engaged is rotated about the rotation shaft 83*b* in the sixth direction R6 to release locking (holding) of the first portion 82 to be engaged by means of the recessed portion 83*a*.

As illustrated in FIGS. 9A and 9B, the link portion 84 is provided with a first link portion 85 and a second link portion 86. A base end of the first link portion 85 is rotatably supported in the vicinity of the rotation shaft 80*a* of the printer body 2 with a rotation shaft 85*a*, which extends in a direction orthogonal to the rotation shaft 80*a*, at the center. The leading end of the first link portion 85 is slidably coupled to the second door 80 so as to slide along the inside of the second door 80 through interlocking with the opening/closing operations of the second door 80. The second link portion 86 is slidably provided in the second door 80 so as to slide by being pressed by the leading end of the first link portion 85. Further, the second link portion 86 is applied with a force downward (direction to the position of the leading end of the first link portion 85) by a non-illustrated spring, and the lower end of the second link portion 86 is in contact with the leading end of the first link portion 85. Moreover, the second link portion 86 is provided with a pressing portion 86*a* capable of pressing the portion 83*c* to be pressed which is provided in the second portion 83 to be engaged. The pressing portion 86*a* slides due to pressing of the second link portion 86 by the leading end of the first link portion 85, and presses the portion 83*c* to be pressed.

Next described is an operation of the link portion 74 at the time when the second door 80 is opened. As illustrated in FIG. 8A, when the second door 80 is rotated in the fifth direction R5 to open the second door 80, the leading end of the first link portion 85 moves downward (fifth direction R5) through interlocking with the operation of the second door 80. Therefore, the second link portion 86 moves downward by the applied force of the non-illustrated spring. On the other hand, when the second door 80 is rotated in the sixth direction R6 and closed, the leading end of the first link portion 85 moves upward (sixth direction R6) through interlocking with the operation of the second door 80. Therefore, the second link portion 86 is pressed by the leading end of the second link portion 86 to move upward against the applied force of the non-illustrated spring.

Figure 10A:
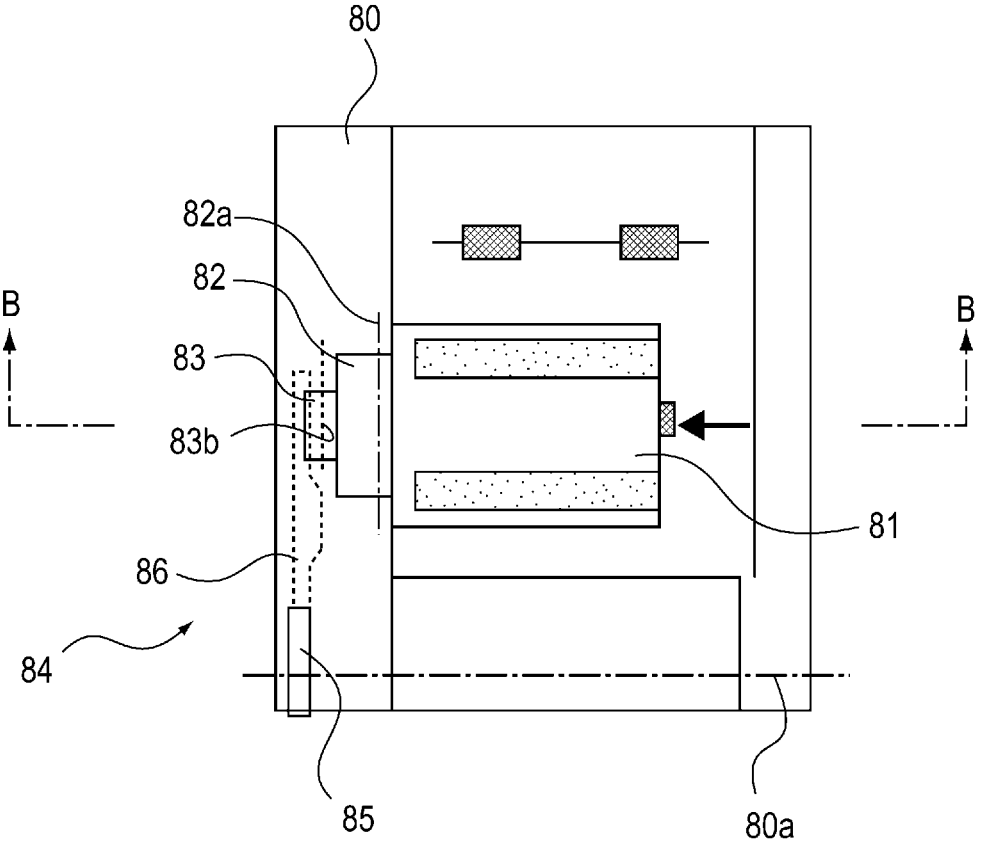
FIG. 10A is a view schematically illustrating a state where the duplex conveying path guide is held in the second door.
Figure 10B:
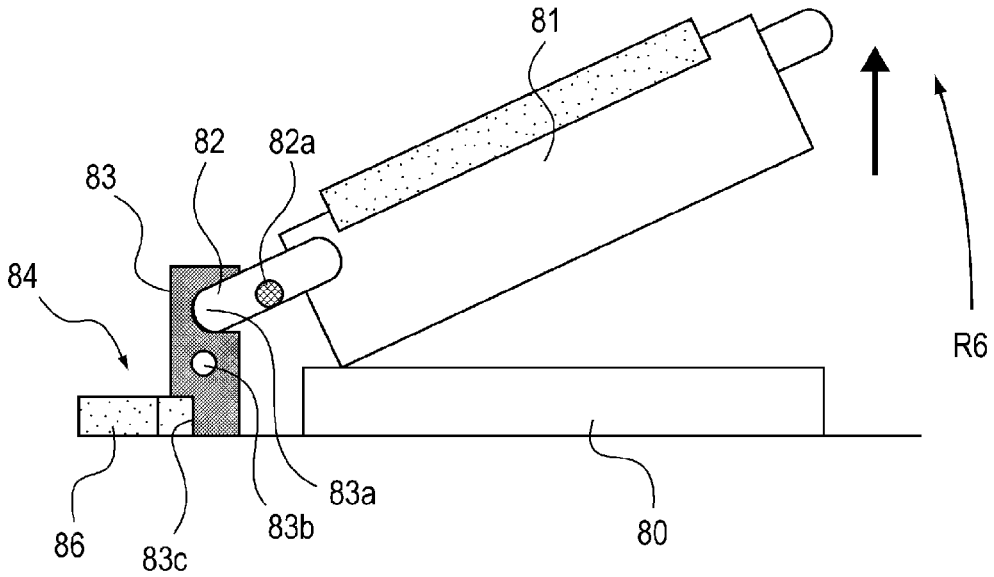
FIG. 10B is a view schematically illustrating a cross section B-B illustrated in FIG. 10A.
Figure 11A:
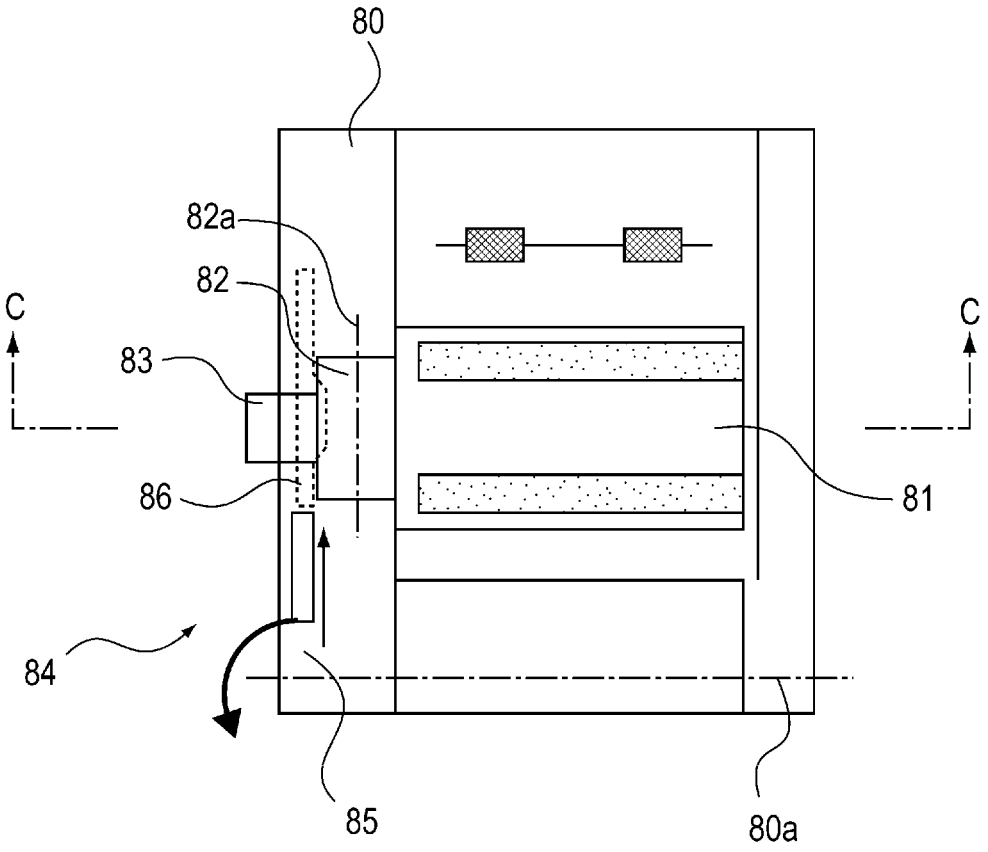
FIG. 11A is a view schematically illustrating a state where the holding state of the duplex conveying path guide in the second door is cancelled.
Figure 11B:
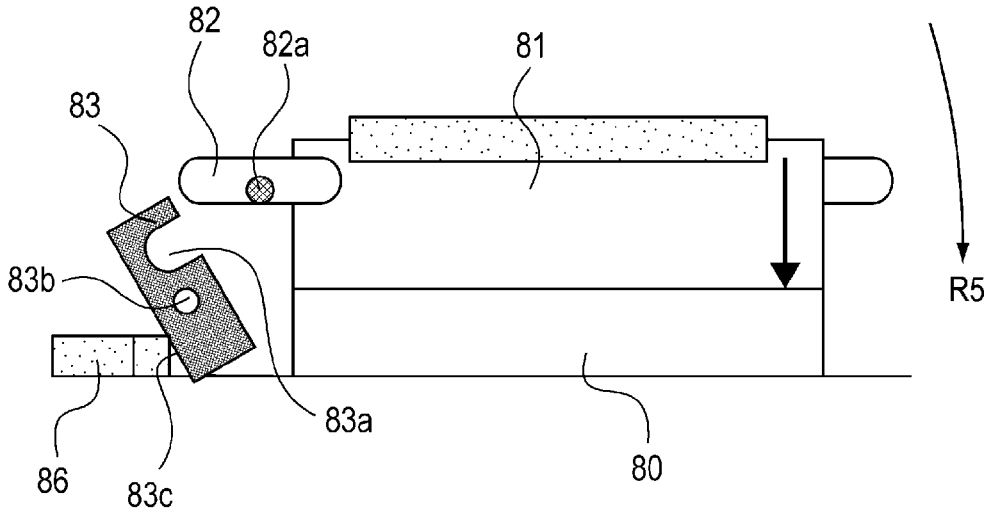
FIG. 11B is a view schematically illustrating a cross section C-C illustrated in FIG. 11A.

Next, the independent holding of the duplex conveying path guide 81 in the second door portion 8 is described with reference to FIGS. 9A to 11D on top of FIGS. 8A and 8B. FIG. 10A is a view schematically illustrating a state where the duplex conveying path guide 81 is held in the second door 80. FIG. 10B is a view schematically illustrating a cross section B-B illustrated in FIG. 10A. FIG. 11A is a view schematically illustrating a state where the holding state of the duplex conveying path guide 81 in the second door 80 is cancelled. FIG. 11B is a view schematically illustrating a cross section C-C illustrated in FIG. 11A.

The duplex conveying path guide 81 is independently held in a position where the duplex conveying path 44 is opened. Further, the second portion 83 to be engaged is applied with the force clockwise by the non-illustrated spring, and abuts a non-illustrated stopper in an erecting position illustrated in FIG. 9A. Therefore, when the user rotates the duplex conveying path guide 81 so as to open the duplex conveying path 44, the second portion 83 to be engaged rotates and the first portion 82 to be engaged, which is coupled to the end of the duplex conveying path guide 81, is held in the recessed portion 83*a* of the second portion 83 to be engaged. Thereby, as illustrated in FIG. 10B, the duplex conveying path guide 81 is held by the second portion to be engaged in the open position. It is to be noted that the duplex conveying path guide 81 is configured so as to allow the second door 80 to be independently held at the time of the opening angle being stopped in a position with a maximal opening angle in the jam recovery, and kept in the open state.

As illustrated in FIGS. 11A and 11B, when the second door 80 is closed while the duplex conveying path guide 81 is held in the open state, the leading end of the 85 presses the second link portion 86 of the first link portion 85 upward at the time of the second door 80 being a predetermined opening angle. When the leading end of the first link portion 85 presses the second link portion 86 upward, the second link portion 86 shifts upward and the pressing portion 86*a* presses the portion 83*c* to be pressed which is provided in the second portion 83 to be engaged. When the pressing portion 86*a* presses the portion 83*c* to be pressed, the second portion 83 to be engaged is rotated counterclockwise about the rotation shaft 83*b*. That is, the second portion 83 to be engaged is pressed, by the first link portion 85, to be rotated so as to come into an inclined state illustrated in FIG. 11B from the erecting position illustrated in FIG. 10B. When the second portion 83 to be engaged is rotated, the engagement between the second portion 83 to be engaged and the first portion 82 to be engaged of the duplex conveying path guide 81 is released. When the engagement between the second portion 83 to be engaged and the first portion 82 to be engaged is released, the duplex conveying path guide 81 is closed under its weight as illustrated in FIG. 11B.

According to the laser beam printer 1 of the present embodiment which has the configuration as thus described, such effects as below are exerted. The laser beam printer 1 according to the present embodiment is provided with the link portion 74 which cancels the holding state of the reverse path guide 71 such that the reverse path guide 71 is closed through interlocking with the closing operation of the first door 70 when the opening angle of the first door 70 becomes smaller than the first opening angle α. Therefore, for example, when the jam recovery is completed, it is possible to make the reverse path guide 71 closed even in a case where the user intends to close the first door 70 without canceling the independent holding of the reverse path guide 71. This can suppress breakage and damage of the reverse path guide 71 even in a case where the user forgets to close the reverse path guide 71 or in some other cases.

Further, when the opening angle of the first door 70 becomes smaller than the first opening angle α, the holding state of the reverse path guide 71 is cancelled. Therefore, for example, in a case where the first door 70 is closed while the reverse path guide 71 is closed after cancellation of the independent holding of the reverse path guide 71, it is possible to suppress the reverse path guide 71 coming into contact with the printer body 2 before completely closing the reverse path guide 71. This can suppress breakage and damage of the reverse path guide 71. Moreover, even when the reverse path guide 71 closes at low speed, it is possible to suppress breakage and damage of the reverse path guide 71.

Further, in the laser beam printer 1, when the opening angle of the first door 70 is smaller than a second opening angle β, the first arm portion 75*b* of the first link portion 75, which is located above the portion 72 to be engaged, functions so as not to allow opening of the reverse path guide 71 (see FIG. 7A). Moreover, when located in a position at an angle not larger than the first opening angle α and not smaller than the second opening angle β (see FIG. 7C), the reverse path guide 71 can be opened and closed, but the independent holding is controlled by the first arm portion 75*b*. Therefore, the reverse path guide 71 can be opened and closed, but is not independently held. It is thereby possible to suppress the reverse path guide 71 coming into contact with the printer body 2 and performing some other operations. This can consequently suppress damage and the like of the reverse path guide 71 and the like. In addition, the second opening angle β refers to an angle at which the reverse path guide 71 and the printer body 2 do not overlap as seen from above the printer body 2.

Further, when the opening angle of the first door 70 is not larger than the first opening angle α and not smaller than the second opening angle β, the position of the first link portion 75 controls movement of a conveying guide 16 such that an engagement member is made movable, but is not made movable to a position where holding force is generated by a toggle spring 19. Therefore, the independent holding of the reverse path guide 71 is controlled. When the opening angle of the first door 70 is small and a distance between the printer body 2 and the reverse path guide is small, controlling the independent holding can make the user aware of the reverse path guide 71 at the time of the jam recovery, thereby prompting the user to close the reverse path guide 71.

Further, for example, when the reverse path guide 71 is allowed to be independently held with the opening angle of the first door 70 being in a small state (not larger than the first opening angle α), the first door 70 might be closed earlier than completion of the movement of the reverse path guide 71 from the open position to the closed position. However, the laser beam printer 1 according to the present embodiment is configured such that the reverse path guide 71 is not held in the open position when the opening angle of the first door 70 is not larger than the first opening angle α. Therefore, for example, when the user closes the first door 70 at a high speed, the first door 70 is closed after completion of the movement of the reverse path guide 71 from the open position to the closed position. It is thereby possible to suppress damage of the reverse path guide 71 due to the reverse path guide 71 coming into contact with the printer body 2.

Further, in the laser beam printer 1 according to the present embodiment, at the time of the opening angle of the reverse path guide 71 being smaller than the second opening angle β, the reverse path guide 71 is not moved by the link portion 75 from the closed position even when the user intends to open the conveying guide 16. It is thereby possible to suppress an erroneous operation by the user.

Further, in the laser beam printer 1 according to the present embodiment, since the first arm portion 75*b* of the first link portion 75 moves in large amount with the movement to close the first door 70, it is possible to reliably move the reverse path guide 71 to the closed position earlier than closing of the first door 70. For example, the link portion 74 is configured such that a movement amount of a portion in the first link portion 75 which is in contact with the portion 72 to be engaged of the reverse path guide 71 is larger than the movement amount of the abutment portion 77*c* of the third link portion 77 with the movement to close the first door 70. It is therefore possible to reduce a space required for arrangement of the first link portion 75, the second link portion 76 and the third link portion 77, while increasing the movement amount of the first link portion 75 so as to reliably move the reverse path guide 71 to the closed position before the first door 70 is closed.

Further, in the laser beam printer 1 according to the present embodiment, the rotation shaft 71*a* of the reverse path guide 71 is located on the side behind the first door 70 when the first door 70 is in a wide open state (e.g. see the state shown by numeral 15, 3 in FIG. 2C). Further, the rotation shaft 71*a* of the reverse path guide 71 extends in a direction orthogonal to the rotation shaft 70*a* of the first door 70. Hence the user can open the reverse path guide 71 from the front side of the first door 70 which is open in the horizontal direction. Moreover, an opening of the reverse path 42 having been opened by rotation of the reverse path guide 71 faces the substantially front of the laser beam printer 1. Thereby, the inside of the reverse path 42 is exposed as seen from the front side of the laser beam printer 1. This results in the laser beam printer 1 having improved operability in the jam recovery and the like.

Further, in the laser beam printer 1 according to the present embodiment, the duplex conveying path guide 81 is not allowed to be independently held in the open state by the second portion 83 to be engaged in a state where the opening angle of the second door 80 is not larger than a predetermined angle. It is thereby possible to suppress the duplex conveying path guide 81 coming into contact with the printer body 2 so as to suppress damage of the duplex conveying path guide 81 and the like.

Further, the duplex conveying path guide 81 of the second door 80 is formed such that a conveying guide 24 is not allowed to be independently held at an opening angle which overlaps as seen from the front of the printer body 2. That is, at the time of the jam recovery, the duplex conveying path guide 81 is made aware by being not independently held when the opening angle of the second door 80 is small and the distance between the printer body 2 and the duplex conveying path guide 81 is small. This can prompt the user to be aware of closing the duplex conveying path guide 81.

The embodiment of the present invention has been described above, but the present invention is not restricted to the foregoing embodiment. Further, the effects described in the embodiment of the present invention are merely a list of the most appropriate effects derived from the present invention, and the effect of the present invention is thus not restricted to those described in the embodiment of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-150244, filed Jun. 30, 2010, which is hereby incorporated by reference herein in its entirety.

What is claimed is:

1. A sheet conveying apparatus comprising:

an apparatus body;

a door portion which is movably supported on the apparatus body;

a conveying guide which forms a sheet conveying path in a state that the door portion is closed, and said conveying guide is movably mounted on the door portion to move between a closure position where the sheet conveying path is formed with the door portion and an opening position where the sheet conveying path is opened in a state that the door portion is opened;

a holding portion which holds the conveying guide in the opening position in a state that the door portion is opened; and an interlock portion which moves with respect to the apparatus body and which interlocks with a closure operation of the door portion so that the interlock portion causes the conveying guide held in the opening position to move to the closure position before the door portion is closed.

2. The sheet conveying apparatus according to claim 1, wherein the interlock portion is movably supported on the door portion and has a first engaging portion to be engaged with the apparatus body and a second engaging portion to be engaged with an engaged portion of the conveying guide, and the interlock portion moves by engaging of the first engaging portion with the apparatus body, such that the second engaging portion presses the engaged portion to close the conveying guide according to the closure operation of the door portion.

3. The sheet conveying apparatus according to claim 2, further comprising a force applying portion which applies a force to the conveying guide in a first direction of opening the conveying guide or in a second direction of closing the conveying guide, which is opposite to the first direction, wherein the force applying portion applies a force to the conveying guide in the first direction in a case where the conveying guide is open with respect to the door portion at an angle not smaller than a predetermined angle, and the force applying portion applies a force to the conveying guide in the second direction in a case where the opening angle of the conveying guide with respect to the door portion is smaller than the predetermined angle.

4. The sheet conveying apparatus according to claim 3, wherein, in the process of the closure operation of the door portion, the conveying guide is moved by the interlock portion to a position where the force applying portion applies the force to the conveying guide in the second direction.

5. The sheet conveying apparatus according to claim 3, wherein the second engaging portion of the interlock portion regulates a movement of opening the conveying guide with respect to the door portion to be smaller than the predetermined angle when the opening angle of the door portion with respect to the apparatus body is smaller than a predetermined opening angle.

6. The sheet conveying apparatus according to claim 1, wherein the conveying guide is rotatably supported on the door portion by a rotation shaft extending in a direction orthogonal to a rotation shaft of the door portion.

7. The sheet conveying apparatus according to claim 1, further comprising a supporting portion, disposed on the door portion, which movably supports the interlock portion.

8. The sheet conveying apparatus according to claim 1, wherein the interlock portion has a plurality of link members which shift according to closure of the door portion.

9. The sheet conveying apparatus according to claim 1, wherein the door portion is rotatably supported on the apparatus body with a shaft that extends in a vertical direction, the conveying guide is rotatably supported on the door portion with a shaft that extends in a horizontal direction, and the sheet conveying path is opened by rotating the conveying guide upwardly in a state that the door portion is opened.

10. The sheet conveying apparatus according to claim 1, further comprising a spring which applies a force to the conveying guide in a first direction for opening the conveying guide in a case where the conveying guide is open with respect to the door portion at an angle larger than a predetermined angle, and applies a force to the conveying guide in a second direction for closing the conveying guide in a case where the opening angle of the conveying guide with respect to the door portion is smaller than the predetermined angle, wherein the interlock portion moves the conveying guide to a position where a force applied by the spring acts on the conveying guide in the second direction with the operation of closing the door portion.

11. The sheet conveying apparatus according to claim 1, wherein the holding portion moves between a first position where the holding portion holds the conveying guide in the opening position and a second position where the holding portion do not hold the conveying guide in the opening position, and the interlock portion moves with respect to the door portion and interlocks with the closure operation of the door portion so that the interlock portion causes the holding portion to move from the first position to the second position.

12. The sheet conveying apparatus according to claim 1, wherein the interlock portion interlocks with the closure of the door portion so that the interlock portion presses the conveying guide to close the conveying guide held in the opening position toward the closure position.

13. An image forming apparatus, comprising:

an image forming portion which forms an image on a sheet;

an apparatus body;

a door portion which is movably supported on the apparatus body;

a conveying guide which forms a sheet conveying path, and is movably mounted on the door portion to move between a closure position where the sheet conveying path is formed with the door portion and an opening position where the sheet conveying path is opened in a state that door portion is opened;

a holding portion which holds the conveying guide in the opening position in a state that the door portion is opened; and an interlock portion which moves with respect to the apparatus body and which interlocks with a closure operation of the door portion so that the interlock portion causes the conveying guide held in the opening position to move to the closure position before the door portion is closed.

14. The image forming apparatus according to claim 13, wherein the interlock portion is movably supported on the door portion and has a first engaging portion to be engaged with the apparatus body and a second engaging portion to be engaged with an engaged portion of the conveying guide, and the interlock portion moves by engaging of the first engaging portion with the apparatus body such that the second engaging portion presses the engaged portion of the conveying guide to close the conveying guide according to the closure operation of the door portion.

15. The image forming apparatus according to claim 14, further comprising a force applying portion which applies a force to the conveying guide in a first direction of opening the conveying guide or in a second direction of closing the conveying guide, which is opposite to the first direction, wherein the force applying portion applies a force to the conveying guide in the first direction in a case where the conveying guide is open with respect to the door portion at an angle not smaller than a predetermined angle, and applies a force to the conveying guide in the second direction in a case where the opening angle of the conveying guide with respect to the door portion is smaller than the predetermined angle.

16. The image forming apparatus according to claim 15, wherein in the process of the closure operation of the door portion, the conveying guide is moved by the interlock portion to a position where the force applying portion applies the force to the conveying guide in the second direction.

17. The image forming apparatus according to claim 15, wherein the second engaging portion of the interlock portion regulates a movement of opening the conveying guide with respect to the door portion to be smaller than the predetermined angle when an opening angle of the door portion with respect to the apparatus body is smaller than a predetermined angle.

18. The image forming apparatus according to claim 13, wherein the conveying guide is rotatably supported on the door portion by a rotation shaft extending in a direction orthogonal to a rotation shaft of the door portion.

19. The image forming apparatus according to claim 13, wherein the holding portion includes a spring which applies a force to the conveying guide in a first direction for opening the conveying guide in a case where the conveying guide is open with respect to the door portion at an angle larger than a predetermined angle, and applies a force to the conveying guide in a second direction for closing the conveying guide in a case where the opening angle of the conveying guide with respect to the door portion is smaller than the predetermined angle; and the interlock portion moves the conveying guide to a position where a force applied by the spring acts the conveying guide in the second direction with the operation of closing the door portion.

20. A sheet conveying apparatus comprising:

an apparatus body;

a door portion which is movably supported on the apparatus body;

a conveying guide which forms a sheet conveying path with the door portion, and is movably supported on the door portion;

a spring which applies a force to the conveying guide in a first direction for opening the conveying guide in a case where the conveying guide is open with respect to the door portion at an angle larger than a predetermined angle, and applies a force to the conveying guide in a second direction for closing the conveying guide in a case where the opening angle of the conveying guide with respect to the door portion is smaller than the predetermined angle; and an interlock portion which moves with respect to the apparatus body to move the conveying guide to a position where a force applied by the spring acts on the conveying guide in the second direction with the operation of closing the door portion.

21. A sheet conveying apparatus according to claim 20, wherein the interlock portion has a first engaging portion which engages with the apparatus body and a second engaging portion which engages with the conveying guide, and the interlock portion moves by engagement of the first engaging portion with the apparatus body with the closure operation of the door portion so that the second engaging portion moves the conveying guide to a position where an angle between the conveying guide and the door portion is smaller than the predetermined angle.

22. A sheet conveying apparatus comprising:

an apparatus body;

a door portion which is movably supported on the apparatus body;

a conveying guide which forms a sheet conveying path with the door portion, and is movably mounted on a shaft being disposed between the door portion and the conveying guide;

a holding portion which holds the conveying guide in an opening position where the sheet conveying path is opened; and an interlock portion which moves with respect to the apparatus body and which interlocks with a closure operation of the door portion so that the interlock portion causes the conveying guide held in the opening position where the sheet conveying path is opened to move to a closure position such that the sheet conveying path is formed before the door portion is closed.

23. The sheet conveying apparatus according to claim 22, wherein the interlock portion is provided near a rotation center of the door portion.

24. The sheet conveying apparatus according to claim 22, wherein the interlock portion engages with the apparatus body and presses the conveying guide in a process of the closing operation of the conveying guide.

25. The sheet conveying apparatus according to claim 22, further comprising a spring which applies a force to the conveying guide in a first direction for opening the conveying guide in a case where the conveying guide is open with respect to the door portion at an angle larger than a predetermined angle, and applies a force to the conveying guide in a second direction for closing the conveying guide in a case where the opening angle of the conveying guide with respect to the door portion is smaller than the predetermined angle, wherein the interlock portion moves the conveying guide to a position where a force applied by the spring acts on the conveying guide in the second direction with the operation of closing the door portion.

* * * * *